US010302369B1

(12) United States Patent
Siebert

(10) Patent No.: US 10,302,369 B1
(45) Date of Patent: May 28, 2019

(54) NON-VANED SWIRL CORE CONFIGURATIONS

(71) Applicant: Brett W. Siebert, Schenectady, NY (US)

(72) Inventor: Brett W. Siebert, Schenectady, NY (US)

(73) Assignee: U.S. Department of Energy, Washington, DC (US)

( * ) Notice: Subject to any disclaimer, the term of this patent is extended or adjusted under 35 U.S.C. 154(b) by 873 days.

(21) Appl. No.: 14/020,983

(22) Filed: Sep. 9, 2013

Related U.S. Application Data

(60) Provisional application No. 61/768,768, filed on Feb. 25, 2013.

(51) Int. Cl.
*F28B 1/00* (2006.01)
*F28F 1/00* (2006.01)

(52) U.S. Cl.
CPC ..... *F28F 1/00* (2013.01)

(58) Field of Classification Search
CPC .... F28F 1/00; F28F 1/025; F28F 1/045; F28F 1/02; F28F 1/04; F28F 13/08
USPC ..... 165/147
See application file for complete search history.

(56) References Cited

U.S. PATENT DOCUMENTS 161,237 A * 3/1875 Jas ..... F28F 13/08 165/147
514,338 A * 2/1894 Row ..... F28F 1/022 122/511
910,192 A * 1/1909 Grouvelle ..... F28F 13/12 138/177
1,780,319 A * 11/1930 Sonneborn ..... H01F 27/12 138/38
3,175,962 A * 3/1965 Holtslag ..... B01D 1/065 122/39

(Continued)

OTHER PUBLICATIONS

Sugiyama, "Elliptical Cross-Sectional Flow Reference" (selected portions), Dept. of Advanced Interdisciplinary Sciences, Graduate School of Engineering, Utsunomiya Univ., Japan, Jan. 2006.

(Continued)

*Primary Examiner* — Tho V Duong
(74) *Attorney, Agent, or Firm* — Robert T. Burns; Jennifer R. Mahalingappa; Brian J. Lally

(57) ABSTRACT

A non-circular coolant passage is disclosed, which includes one or more walls axially defining a flow path; an inlet connecting to a first end of the flow path; and an exit connecting to a second end of the flow path, wherein a size of a passage cross-section varies in the axial direction. In certain exemplary embodiments the passage cross-section size varies uniformly, while in others the passage cross-section size varies incrementally. In certain exemplary embodiments, an angular orientation of the passage cross-section varies in the axial direction. The cross-section angular orientation can vary uniformly, incrementally, or a combination of both. In still other embodiments, both the size of the passage cross-section and the angular orientation of the passage cross-section vary in the axial direction. In these embodiments, the passage cross-section size and/or the angular orientation of the passage cross-section can vary uniformly, incrementally, and/or a combination of the two.

15 Claims, 75 Drawing Sheets

Triangular Radial Pitch Arrangement
Triangular cross section, smoothly varying size, smoothly varying twist, fillet

(56) References Cited

U.S. PATENT DOCUMENTS

| | | | | |
|---|---|---|---|---|
| 5,251,693 | A * | 10/1993 | Zifferer | F28D 7/0041 165/160 |
| 5,318,113 | A * | 6/1994 | Potier | F28D 1/05366 165/173 |
| 7,080,683 | B2 * | 7/2006 | Bhatti | F28D 1/05391 165/173 |
| 2007/0209788 | A1 * | 9/2007 | Jing | F28D 7/026 165/177 |
| 2008/0173436 | A1 * | 7/2008 | Baylis | F02B 29/0462 165/173 |
| 2008/0289808 | A1 * | 11/2008 | Schrader | F28F 9/185 165/181 |
| 2012/0193074 | A1 * | 8/2012 | Panumma | F28D 7/0066 165/104.11 |

OTHER PUBLICATIONS

White, "Fluid Mechanics, Sixth Edition" (selected portions) McGraw Hill Higher Education.

* cited by examiner

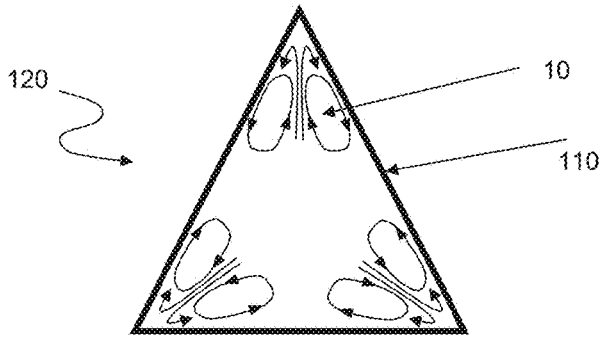

Swirling Flow Patterns in a Straight, Non-Circular Cross-Section Geometry (Axial Slice)
Triangular Cross-Section
Figure 1

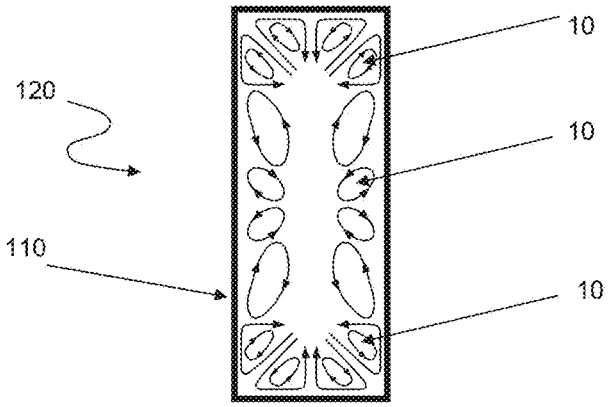

Swirling Flow Patterns in a Straight, Non-Circular Cross-Section Geometry (Axial Slice)
Rectangular Cross-Section, also applicable to Square Cross-Section
Figure 2

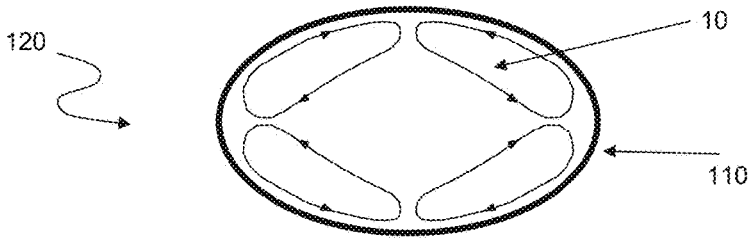

Swirling Flow Patterns in a Straight, Non-Circular Cross-Section Geometry (Axial Slice)
Elliptical Cross-Section
Figure 3

Triangular cross section, uniform size, no twist, no fillet

Square cross section, uniform size, no twist, no fillet

Ellipsoidal cross section, uniform size, no twist, fillet N/A

Coolant System configuration (Coolant Passages connecting Plenums)

Triangular cross section, uniform size, uniform twist, no fillet

Square cross section, uniform size, uniform twist, no fillet

Ellipsoidal cross section, uniform size, uniform twist, fillet N/A

Triangular cross section, uniform size, no twist, fillet

Square cross section, uniform size, no twist, fillet

Triangular cross section, uniform size, uniform twist, fillet

Square cross section, uniform size, uniform twist, fillet

Triangular cross section, segment varying size, no twist, no fillet

Square cross section, segment varying size, no twist, no fillet

Elliptical cross section, segment varying size, no twist, fillet N/A

Triangular cross section, smoothly varying size, no twist, no fillet

Square cross section, smoothly varying size, no twist, no fillet

Elliptical cross section, smoothly varying size, no twist, fillet N/A

Triangular cross section, segment varying size, no twist, fillet

Square cross section, segment varying size, no twist, fillet

Triangular cross section, smoothly varying size, no twist, fillet

Square cross section, smoothly varying size, no twist, fillet

Triangular cross section, uniform size, segment varying twist, no fillet

Square cross section, uniform size, segment varying twist, no fillet

Elliptical cross section, uniform size, segment varying twist, fillet N/A

Triangular cross section, uniform size, smoothly varying twist, no fillet

Square cross section, uniform size, smoothly varying twist, no fillet

Elliptical cross section, uniform size, smoothly varying twist, fillet N/A

Triangular cross section, uniform size, segment varying twist, fillet

Square cross section, uniform size, segment varying twist, fillet

Triangular cross section, uniform size, smoothly varying twist, fillet

Square cross section, uniform size, smoothly varying twist, fillet

Triangular cross section, segment varying size, segment varying twist, no fillet Square cross section, segment varying size, segment varying twist, no fillet Elliptical cross section, segment varying size, segment varying twist, fillet N/A Triangular cross section, smoothly varying size, smoothly varying twist, no fillet Square cross section, smoothly varying size, smoothly varying twist, no fillet Elliptical cross section, smoothly varying size, smoothly varying twist, fillet N/A Triangular cross section, segment varying size, segment varying twist, fillet Square cross section, segment varying size, segment varying twist, fillet Triangular cross section, smoothly varying size, smoothly varying twist, fillet Square cross section, smoothly varying size, smoothly varying twist, fillet Square Radial Pitch Arrangement
Triangular cross section, smoothly varying size, smoothly varying twist, fillet Square Radial Pitch Arrangement
Square cross section, smoothly varying size, smoothly varying twist, fillet Square Radial Pitch Arrangement
Elliptical cross section, smoothly varying size, smoothly varying twist, fillet N/A Triangular Radial Pitch Arrangement
Triangular cross section, smoothly varying size, smoothly varying twist, fillet Triangular Radial Pitch Arrangement
Square cross section, smoothly varying size, smoothly varying twist, fillet Triangular Radial Pitch Arrangement
Elliptical cross section, smoothly varying size, smoothly varying twist, fillet N/A Cross-Sectional View
Hexagonal Radial Pitch Arrangement
Triangular Cross-Section, Untwisted Walls, no fillet Cross-Sectional View
Hexagonal Radial Pitch Arrangement
Triangular Cross-Section, Untwisted Walls, fillet Hexagonal Radial Pitch Arrangement
Triangular Cross-Section, Untwisted Walls, no fillet Hexagonal Radial Pitch Arrangement
Triangular Cross-Section, Untwisted Walls, fillet

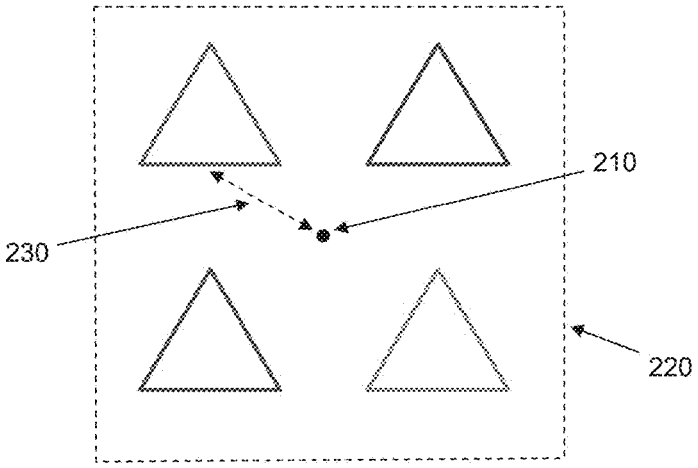
Axial Pitch Fraction: 0
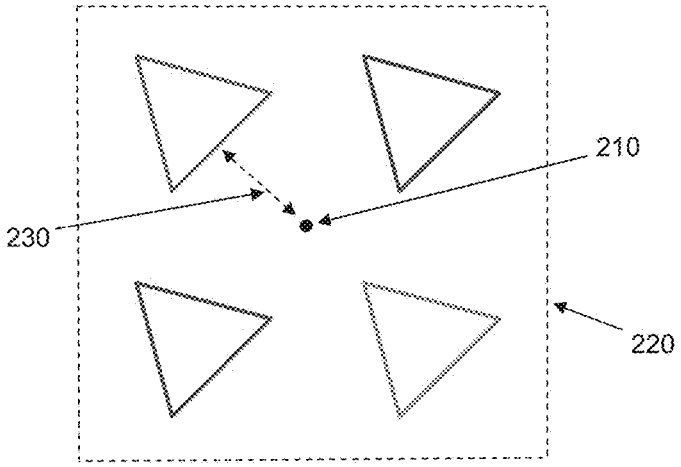
Axial Pitch Fraction: 1/8
Square Radial Pitch, Triangle Cross Section
Alignment of Radial Pitch and Geometry,
Creating Large Axial Pitch-Aligned Inter-Passage Ligaments
(Angular Offset = 0°)
Figure 55

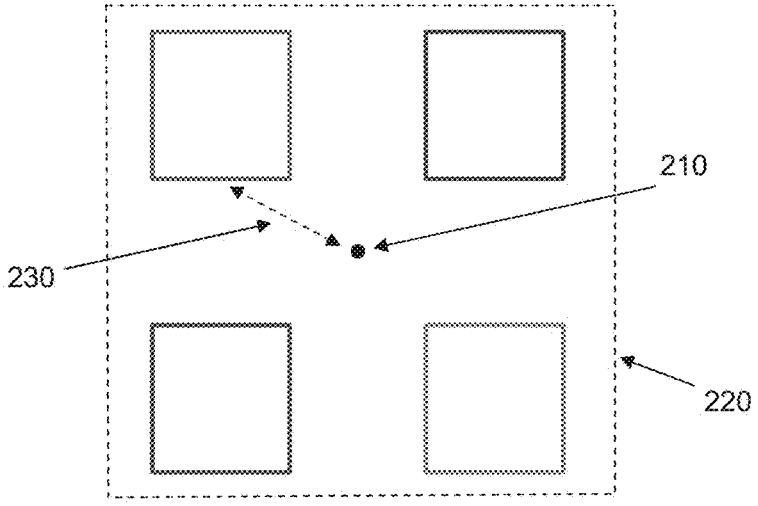
Low Centroid-Coolant Passage Separation (Axial Pitch Fraction: 0)
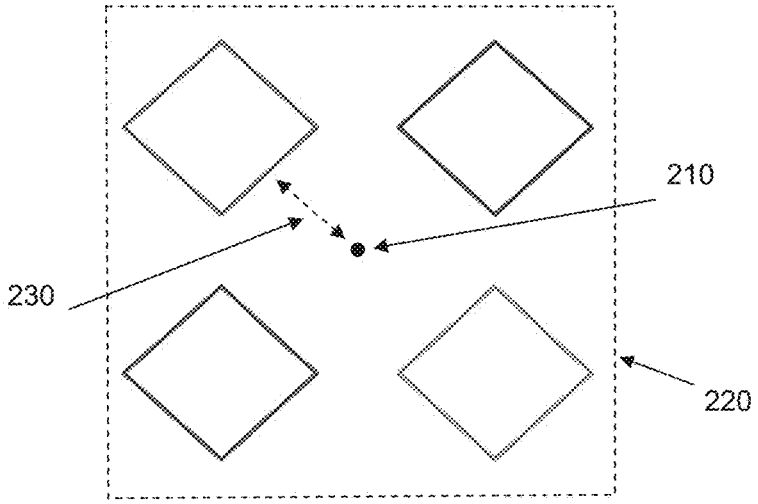
High Centroid-Coolant Passage Separation (Axial Pitch Fraction: 1/8)
Square Radial Pitch, Square Cross Section
Variation in Centroid-Coolant Passage Separation
Relative Angular Offset = 0°
Figure 56

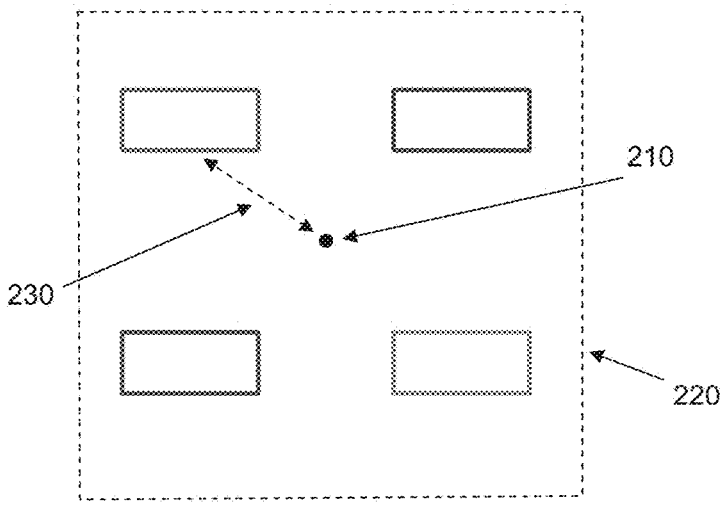
High Centroid-Coolant Passage Separation (Axial Pitch Fraction: 0)
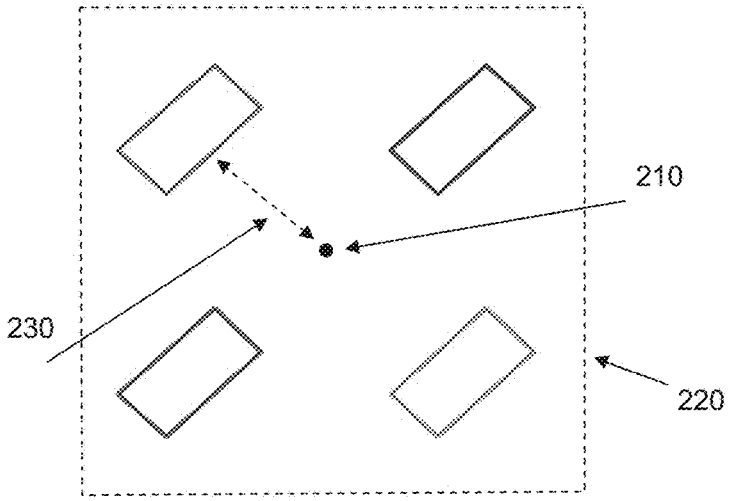
Low Centroid-Coolant Passage Separation (Axial Pitch Fraction: 1/8)
Square Radial Pitch, Elliptical/Rectangle Cross Section
Variation in Centroid-Coolant Passage Separation
Relative Angular Offset = 0°
Figure 57

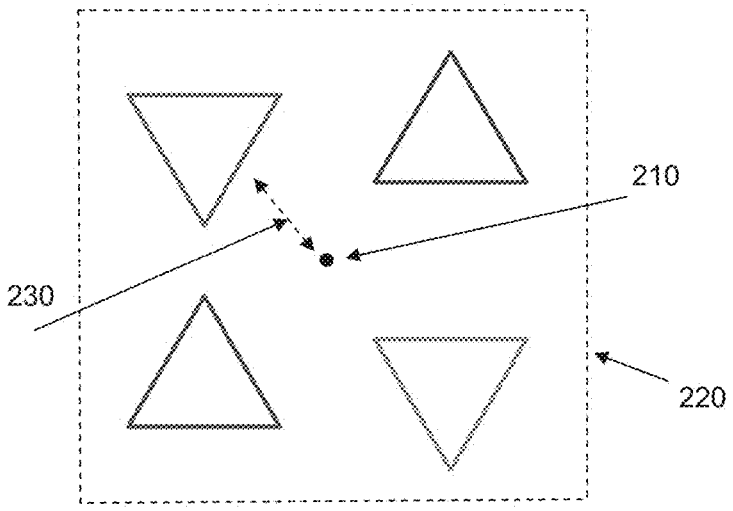
Axial Pitch Fraction: 0, repeating every 1/12 Axial Pitch
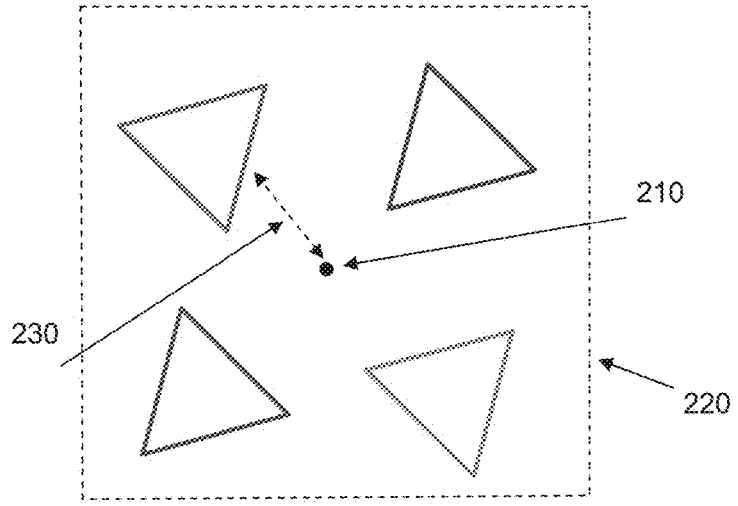
Axial Pitch Fraction: 1/24
Square Radial Pitch, Triangle Cross-Section
Proposed Angular Offset Pattern, (Angular Offset = 60°)
Figure 58

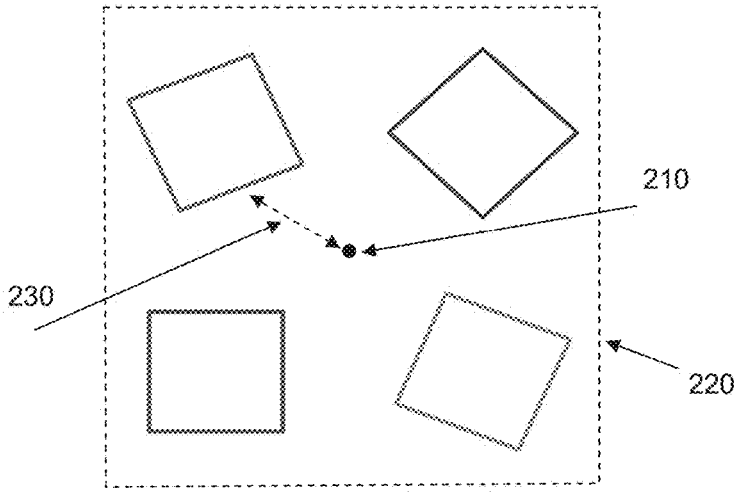
Axial Pitch Fraction: 0, repeating every 1/16 Axial Pitch
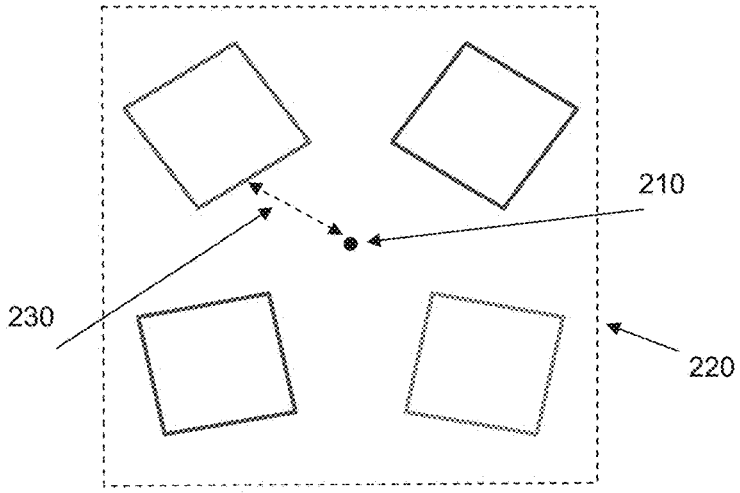
Axial Pitch Fraction: 1/32
Square Radial Pitch, Square Cross-Section
Proposed Angular Offset Pattern, (Angular Offset = 67.5°)
Figure 59

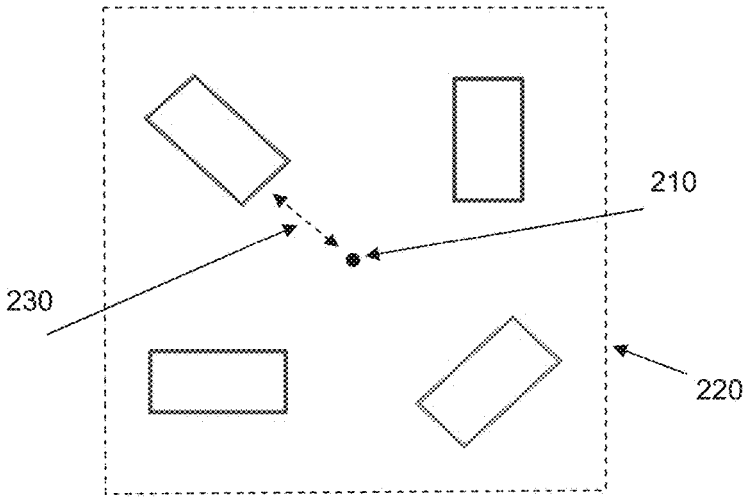
Axial Pitch Fraction: 0, repeating every 1/8 Axial Pitch
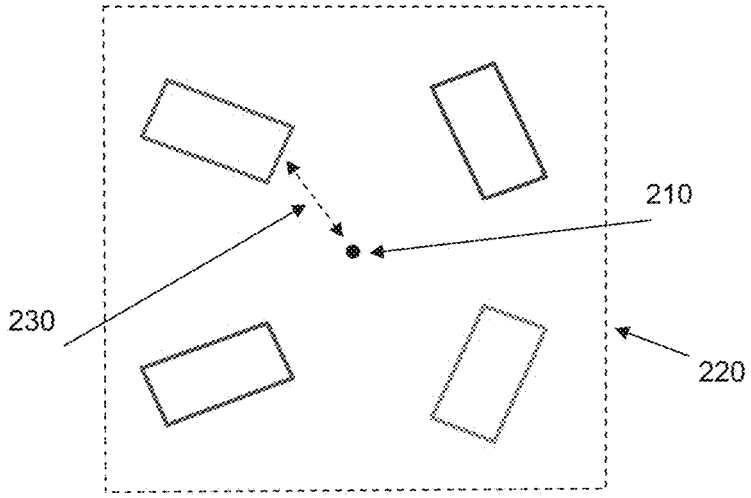
Axial Pitch Fraction: 1/16
Square Radial Pitch, Elliptical/Rectangle Cross-Section
Proposed Angular Offset Pattern, (Angular Offset = 45°)
Figure 60

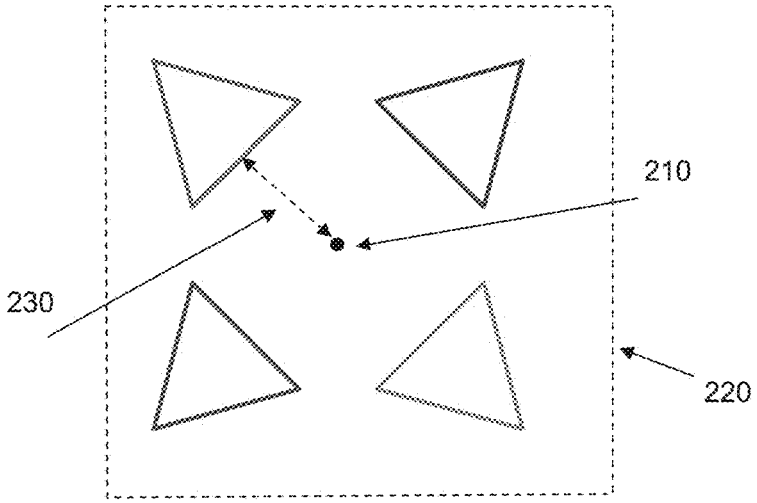
High Centroid-Coolant Passage Separation (Axial Pitch Fraction: 1/24)
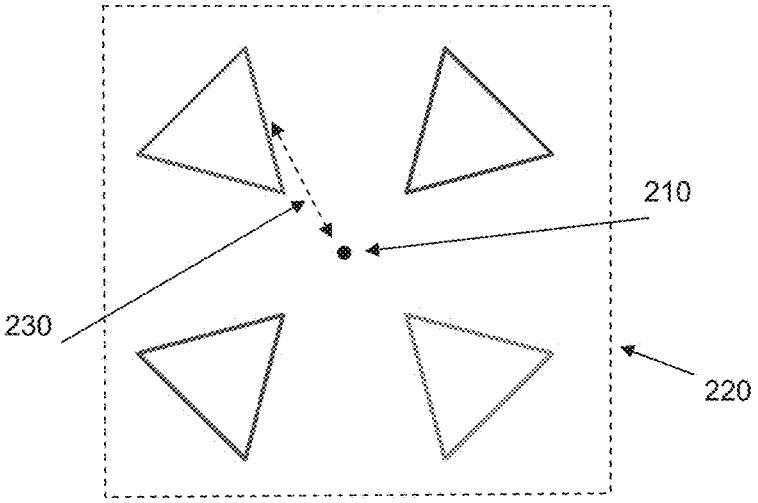
Low Centroid-Coolant Passage Separation (Axial Pitch Fraction: 5/24)
Square Radial Pitch, Triangle Cross Section
Variation in Centroid-Coolant Passage Separation
Relative Angular Offset = 90°
Figure 61

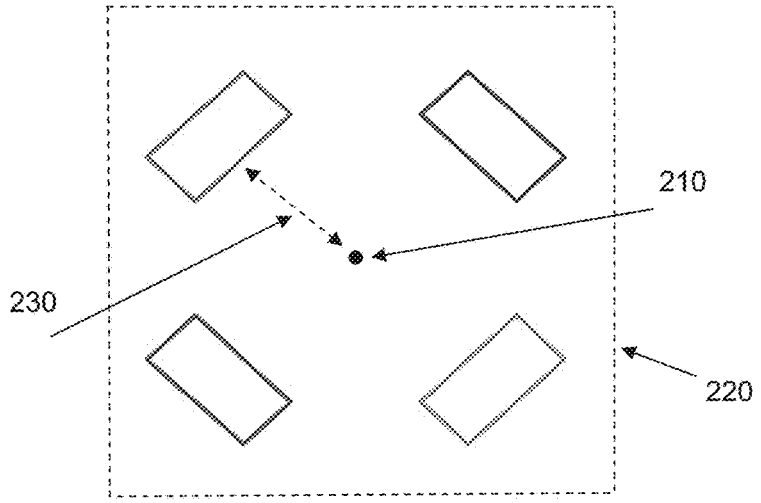
High Centroid-Coolant Passage Separation (Axial Pitch Fraction: 3/8)
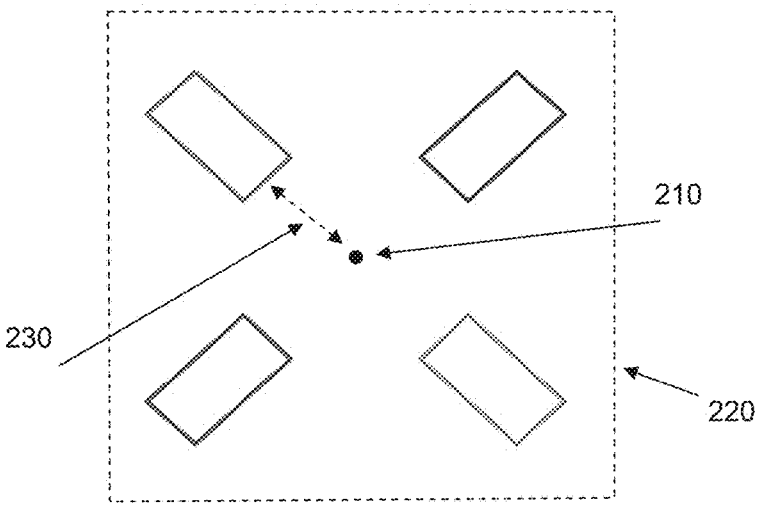
Low Centroid-Coolant Passage Separation (Axial Pitch Fraction: 1/8)
Square Radial Pitch, Elliptical/Rectangle Cross Section
Variation in Centroid-Coolant Passage Separation
Relative Angular Offset = 90°
Figure 62

Square Radial Pitch Arrangement
Relative Angular Offset Distribution Pattern

Triangular Radial Pitch Arrangement
Relative Angular Offset Distribution Pattern Square Radial Pitch, Triangle Cross Section
Average Distance between Radial Pitch Centroid & Coolant Passage Walls
as a Function of Axial Pitch
(Variation with Relative Angular Offset)

Square Radial Pitch, Square Cross Section
Average Distance between Radial Pitch Centroid & Coolant Passage Walls
as a Function of Axial Pitch
(Variation with Relative Angular Offset)

Square Radial Pitch, Elliptical/Rectangular Cross Section
Average Distance between Radial Pitch Centroid & Coolant Passage Walls
as a Function of Axial Pitch
(Variation with Relative Angular Offset)

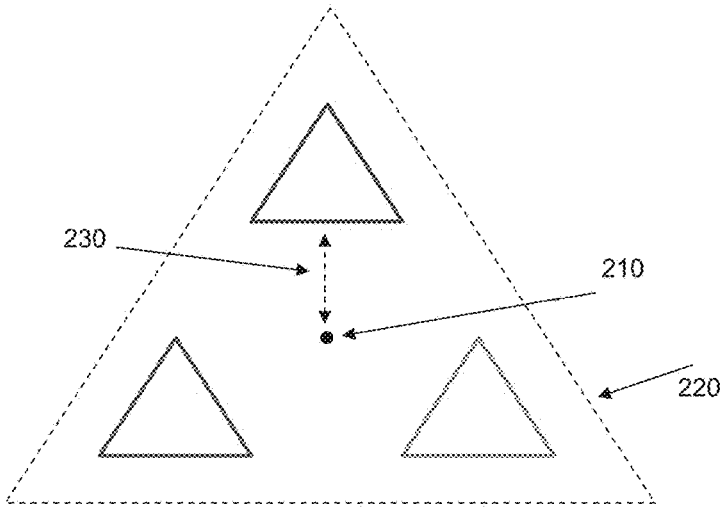
High Centroid-Coolant Passage Separation (Axial Pitch Fraction: 0)
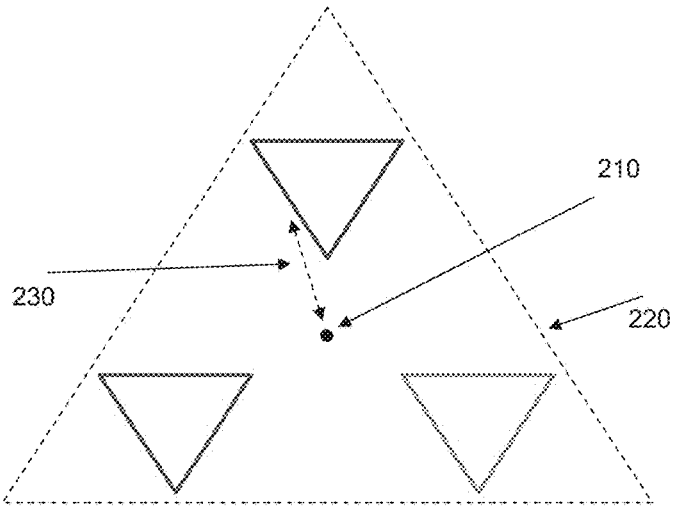
Low Centroid-Coolant Passage Separation (Axial Pitch Fraction: 1/6)
Triangle Radial Pitch, Triangle Cross Section
Variation in Centroid-Coolant Passage Separation
Relative Angular Offset = 0°
Figure 68

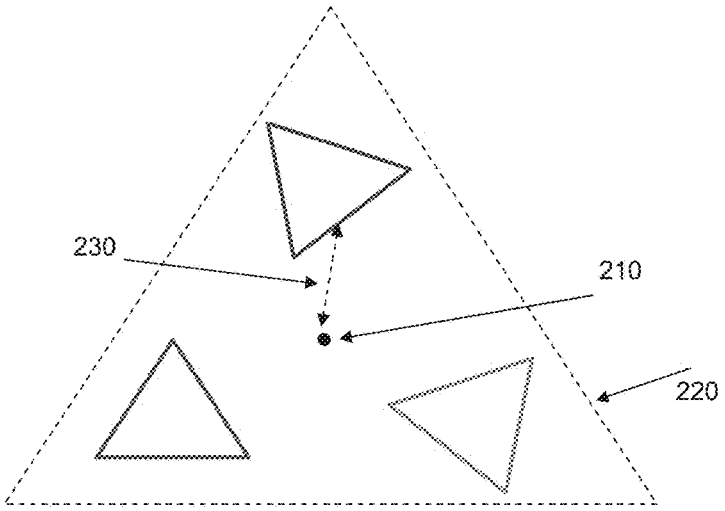
Axial Pitch Fraction: 0, repeating every 1/9 Axial Pitch
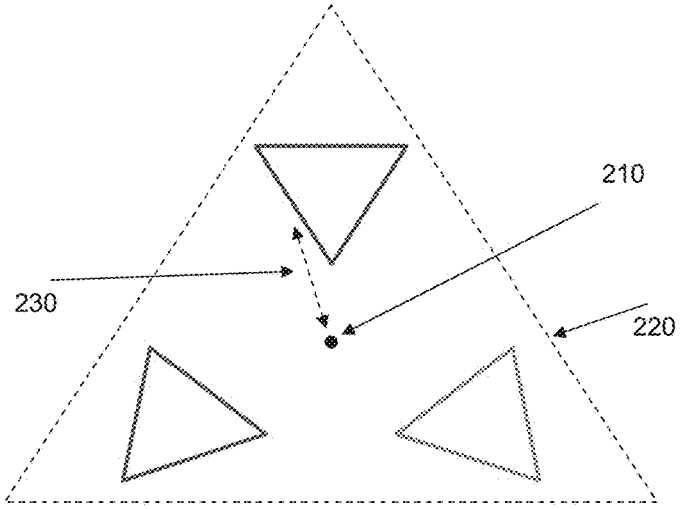
Axial Pitch Fraction: 1/18
Triangle Radial Pitch, Triangle Cross-Section
Proposed Angular Offset Pattern, (Angular Offset = 80°)
Figure 69

Triangle Radial Pitch, Triangle Cross-Section
Average Distance between Radial Pitch Centroid & Coolant Passage Walls
as a Function of Axial Pitch
(Variation with Relative Angular Offset)

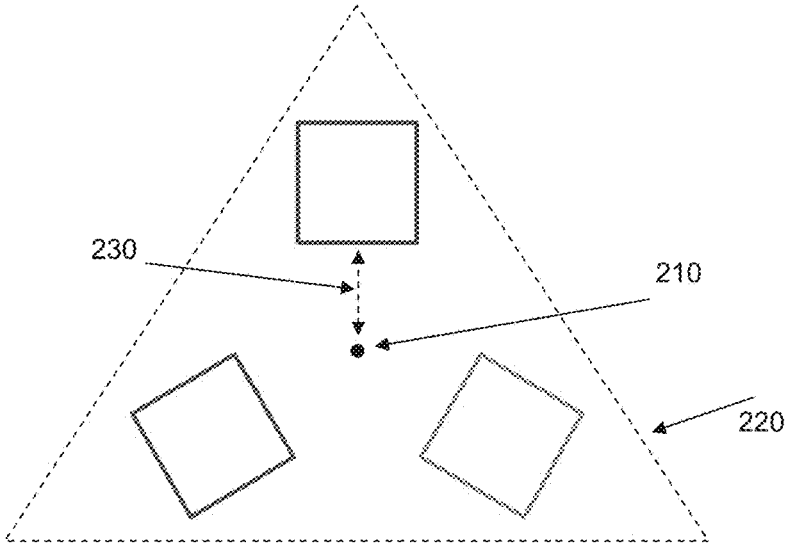
High Centroid-Coolant Passage Separation (Axial Pitch Fraction: 5/24)
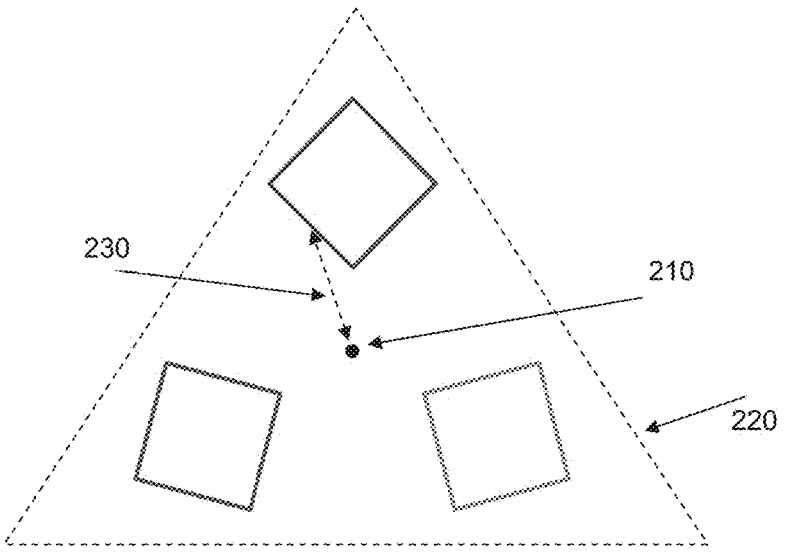
Low Centroid-Coolant Passage Separation (Axial Pitch Fraction: 1/12)
Triangular Radial Pitch, Square Cross Section
Variation in Centroid-Coolant Passage Separation
Relative Angular Offset = 30°
Figure 71

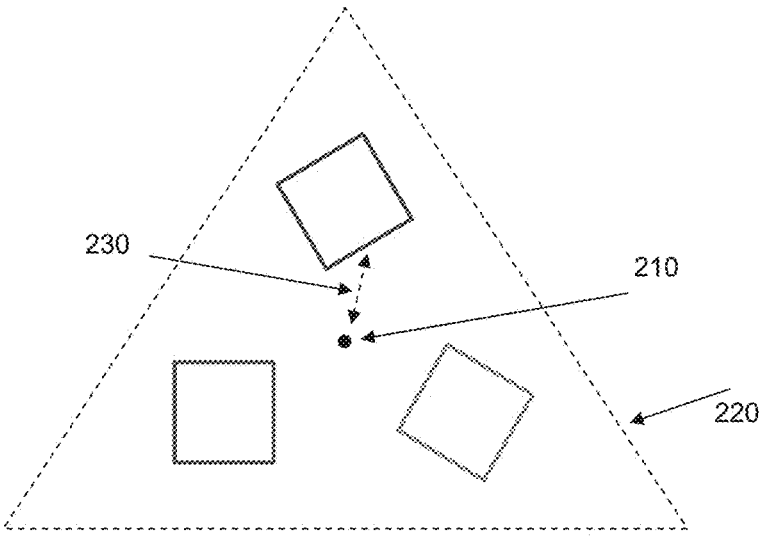
Axial Pitch Fraction: 1/24
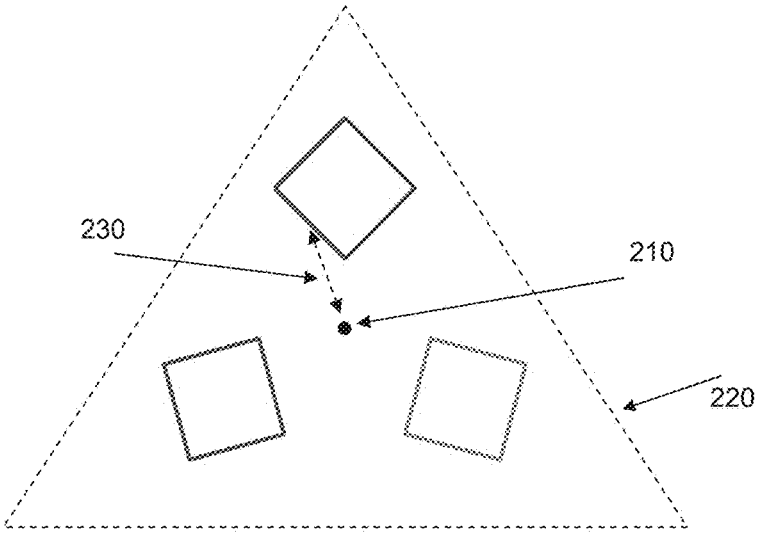
Axial Pitch Fraction: 1/6
Triangle Radial Pitch, Square Cross-Section
Alignment of Radial Pitch and Geometry,
Creating Large Axial Pitch-Aligned Inter-Passage Ligaments
(Angular Offset = 60°)
Figure 72

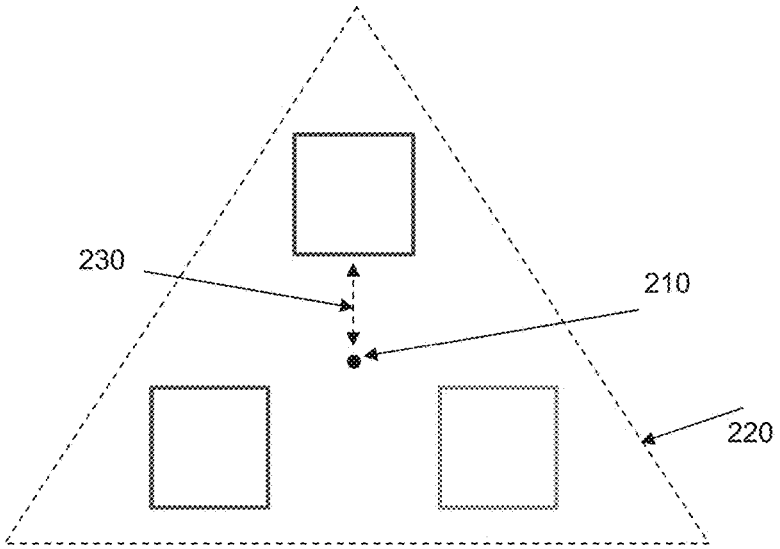
Axial Pitch Fraction: 0, repeating every 1/12 Axial Pitch
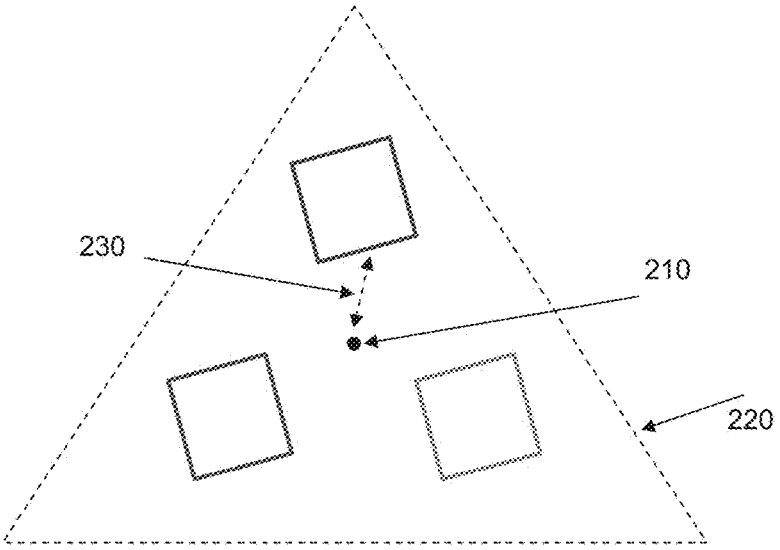
Axial Pitch Fraction: 1/24
Triangle Radial Pitch, Square Cross-Section
Proposed Angular Offset Pattern, (Angular Offset = 90°)
Figure 73

Triangle Radial Pitch, Square Cross-Section
Average Distance between Radial Pitch Centroid & Coolant Passage Walls
as a Function of Axial Pitch
(Variation with Relative Angular Offset)

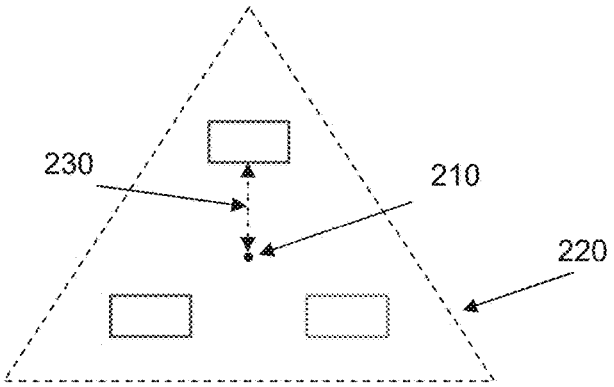
Axial Pitch Fraction: 0
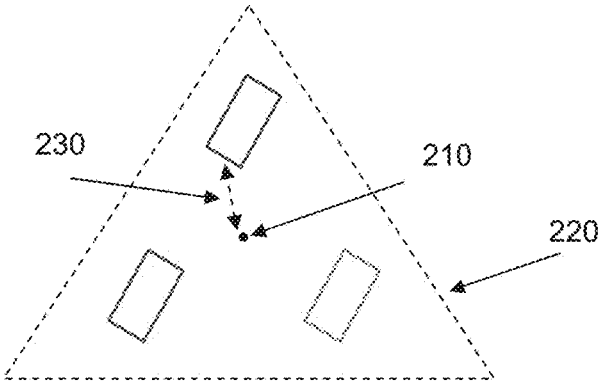
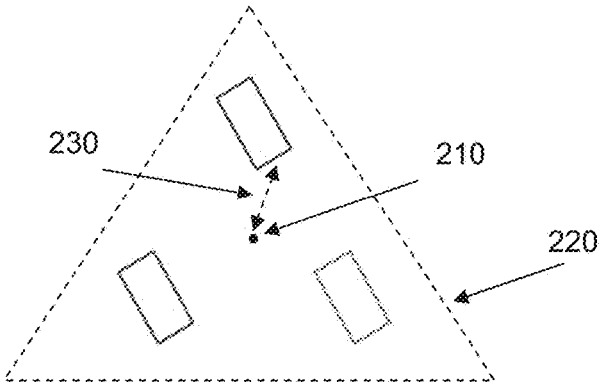
Axial Pitch Fraction: 2/6
Triangle Radial Pitch, Elliptical/Rectangle Cross-Section
Alignment of Radial Axial Pitch and Geometry,
Creating Large Axial Pitch-Aligned Inter-Passage Ligaments
(Angular Offset = 0°)
Figure 75

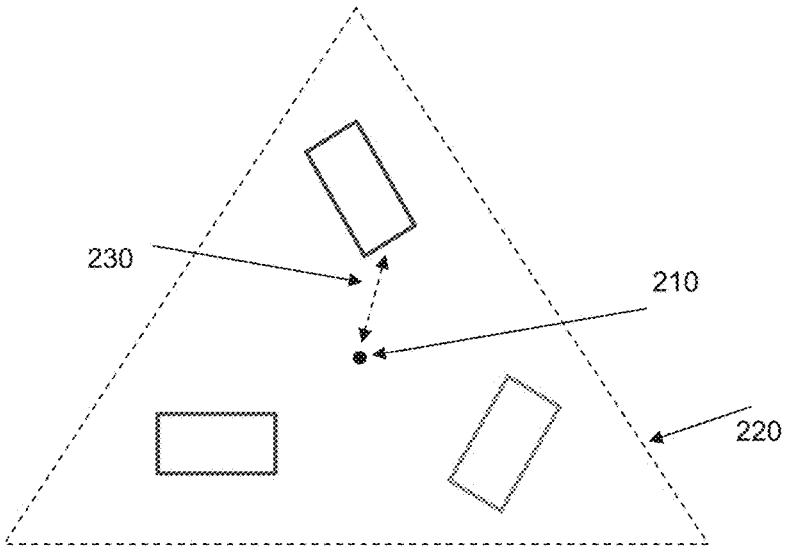
Axial Pitch Fraction: 0, repeating every 1/6 Axial Pitch
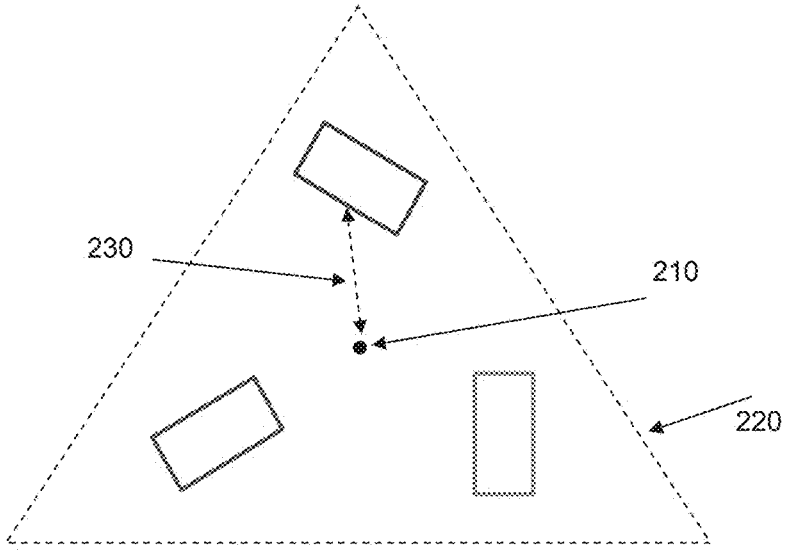
Axial Pitch Fraction: 1/12
Triangle Radial Pitch, Elliptical/Rectangle Cross-Section
Proposed Angular Offset Pattern, (Angular Offset = 60°)
Figure 76

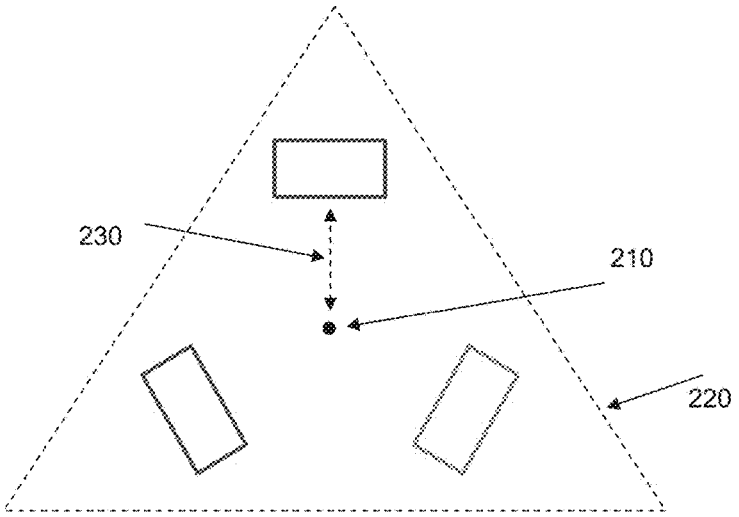
High Centroid-Coolant Passage Separation (Axial Pitch Fraction: 1/3)
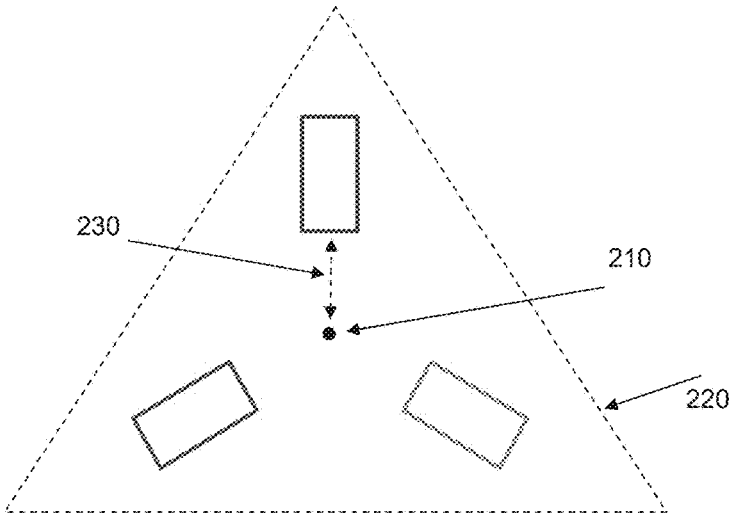
Low Centroid-Coolant Passage Separation (Axial Pitch Fraction: 1/12)
Triangle Radial Pitch, Elliptical/Rectangle Cross Section
Variation in Centroid-Coolant Passage Separation
Relative Angular Offset = 120°
Figure 77

Triangle Radial Pitch, Elliptical/Rectangular Cross Section
Average Distance between Radial Pitch Centroid & Coolant Passage Walls
as a Function of Axial Pitch
(Variation with Relative Angular Offset)

NON-VANED SWIRL CORE CONFIGURATIONS

NOTICE OF GOVERNMENT RIGHTS

The United States Government has rights in this application and any resultant patents claiming priority to this application pursuant to contract DE-AC12-00SN39357 between the United States Department of Energy and Bechtel Marine Propulsion Corporation Knolls Atomic Power Laboratory.

BACKGROUND

In a nuclear reactor it is important to keep peak centerline temperatures below structural and material integrity limits for safe and controllable operation. Heat energy generated by nuclear reactions is transferred to a coolant and converted into useful forms of energy such as electrical power or propulsion. In plants using liquid coolant, fluid flows through coolant passages and a heat exchange boundary forms where coolant contacts passage surfaces. Coolant passage designs include internal and external flow configurations. In internal configurations, a heated structure at least partially surrounds a perimeter of each coolant passage such that coolant flows in passages within the heated structure. One example of an internal configuration is a block with one or more coolant passages inside the block. The block is cooled with coolant passing through these passages. In an external configuration, coolant flow is external to the heated structure. An example of an external flow configuration is an array of fuel pins as the heated structure, with coolant flowing over the exterior of the pins.

Simple convective heat transfer occurs when coolant is in either a purely liquid or a purely gaseous state. More complex heat transfer occurs during boiling, when liquid coolant transitions to a vapor within a coolant passage. During boiling, heat transfer occurs through three heat transfer mechanisms—heat transfer to liquid coolant, the latent heat of vaporization as liquid coolant transforms to vapor, and heat transfer to coolant vapor. Liquid effectively transfers large amounts of heat, and boiling actually increases heat transfer effectiveness as long a sufficient supply of liquid coolant remains to absorb the latent heat of vaporization. If the liquid coolant boils completely away, however, vapor is all that remains in contact with the passage wall. Vapor is a relatively poor heat transfer medium, and transfers much less heat than liquid coolant. With only vapor left to transfer heat, heat transfer degrades and temperatures can suddenly increase. The point at which the sudden heat transfer degradation occurs is referred to as the Critical Heat Flux (CHF) point, the Departure from Nucleate Boiling (DNB) point, and/or the dryout point. Power generation in the fuel does not halt when the heat transfer degrades, and CHF can result in a temperature excursion within the fuel and clad. These excursions can jeopardize structural or material integrity of the core.

Swirling coolant flow is one way to increase heat transfer and help prevent CHF onset in flowing coolant. Inducing swirling flow can delay and/or prevent the onset of CHF by creating a pressure gradient within a coolant passage. Swirling the coolant creates a pressure gradient towards the center of rotation. For example, in an internal flow configuration, swirling the coolant lowers pressure at the center of a passage relative to the pressure on passage walls. Coolant vapor, being less dense than liquid coolant, is more responsive to the pressure gradient and moves toward the passage center more readily than liquid coolant. This keeps passage walls wetted with liquid coolant rather than coolant vapor, delaying or preventing the onset of CHF. Swirling flow also increases single-phase heat transfer effectiveness. In single-phase heat transfer, swirling flow speeds up coolant velocity over passage walls, increasing heat transfer.

In existing designs, swirling flow is weak due to the use of straight passage walls. FIGS. 1-3 illustrate exemplary flow structures present in triangular, rectangular, and elliptical straight-walled passage cross-sections. Swirling flow velocity in these structures is only approximately 1% of the axial coolant flow velocity. To increase swirling flow (swirl), these designs utilize coolant fins or rifling. Using vanes or rifling to coolant passages is problematic, however, as existing manufacturing constraints restrict physical access along the full length of coolant passages. Moreover, even with fins or rifling, it is difficult to induce swirling flow in non-circular coolant passages. Thus, a need exists for coolant passages having non-circular cross-sections with non-vaned swirl mechanisms.

SUMMARY

A non-circular coolant passage is disclosed, which includes one or more walls axially defining a flow path; an inlet connecting to a first end of the flow path; and an exit connecting to a second end of the flow path, wherein a size of a passage cross-section varies in the axial direction. In certain exemplary embodiments the passage cross-section size varies uniformly, while in others the passage cross-section size varies incrementally. In certain exemplary embodiments, an angular orientation of the passage cross-section varies in the axial direction. The cross-section angular orientation can vary uniformly, incrementally, or a combination of both. In still other embodiments, both the size of the passage cross-section and the angular orientation of the passage cross-section vary in the axial direction. In these embodiments the passage cross-section size and/or the angular orientation of the passage cross-section can vary uniformly, incrementally, and/or a combination of the two. Still other exemplary embodiments include at least one fillet defining at least one smooth finite radius of curvature between at least two adjoining passage walls.

Another exemplary embodiment includes a coolant system having an inlet plenum, an outlet plenum, and a plurality of coolant passages connected in parallel between the inlet plenum and the exit plenum, wherein a size of at least one passage cross-section varies in an axial direction. In certain exemplary embodiments, an angular orientation of the cross-section of at least one coolant passage varies in the axial direction. In still other exemplary embodiments, the plurality of passages forms a cell having a square cellular pitch, while in other exemplary embodiments the plurality of passages forms a cell having a triangular cellular pitch, a hexagonal cellular pitch, or some other cellular pitch shape. In certain exemplary embodiments, a wall of at least one of the plurality of coolant passage is opposite another wall of another of the plurality of coolant passages. In still further exemplary embodiments, at least two of the plurality of coolant passages share a common angular variation, and in other exemplary embodiments, an angular offset of each of the plurality of passage is defined by the equation $A_{OI}=360°\times Np\ (1-1/Nc)$.

BRIEF DESCRIPTION OF THE DRAWINGS

A description of the present subject matter including various embodiments thereof is presented with reference to the accompanying drawings, the description not meaning to be considered limiting in any matter, wherein:

FIG. 1 illustrates swirl in a straight passage having a triangular cross-section;

FIG. 2 illustrates swirl in straight passage having a rectangular cross-section;

FIG. 3 illustrates swirl in straight passage having an elliptical cross-section;

FIG. 55 illustrates an exemplary cell in a square cellular pitch with passages having triangular cross-sections and a 0 degree relative angular offset;

FIG. 56 illustrates an exemplary cell in a square cellular pitch with passages having square cross-sections and a 0 degree relative angular offset;

FIG. 57 illustrates an exemplary cell in a square cellular pitch with passages having elliptical/rectangular cross-sections and a 0 degree relative angular offset;

FIG. 58 illustrates an exemplary cell in a square cellular pitch with passages having triangular cross-sections and a 60 degree relative angular offset;

FIG. 59 illustrates an exemplary cell in a square cellular pitch with passages having square cross-sections and a 67.5 degree relative angular offset;

FIG. 60 illustrates an exemplary cell in a square cellular pitch with passages having elliptical/rectangular cross-sections and a 45 degree relative angular offset;

FIG. 61 illustrates an exemplary cell in a square cellular pitch with passages having triangular cross-sections and a 90 degree relative angular offset;

FIG. 62 illustrates an exemplary cell in a square cellular pitch with passages having elliptical/rectangular cross-sections and a 90 degree relative angular offset;

FIG. 68 illustrates an exemplary cell in a triangular cellular pitch with passages having triangular cross-sections and a 0 degree relative angular offset;

FIG. 69 illustrates an exemplary cell in a triangular cellular pitch with passages having triangular cross-sections and an 80 degree relative angular offset;

FIG. 71 illustrates an exemplary cell in a triangular cellular pitch with passages having triangular square cross-sections and a 30 degree relative angular offset;

FIG. 72 illustrates an exemplary cell in a triangular cellular pitch with passages having square cross-sections and a 60 degree relative angular offset;

FIG. 73 illustrates an exemplary cell in a triangular cellular pitch with passages having square cross-sections and a 90 degree relative angular offset;

FIG. 75 illustrates an exemplary cell in a triangular cellular pitch with passages having elliptical/rectangular cross-sections and a 0 degree relative angular offset;

FIG. 76 illustrates an exemplary cell in a triangular cellular pitch with passages having elliptical/rectangular cross-sections and a 60 degree relative angular offset;

FIG. 77 illustrates an exemplary cell in a triangular cellular pitch with passages having elliptical/rectangular cross-sections and a 120 degree relative angular offset.

Figure 4:
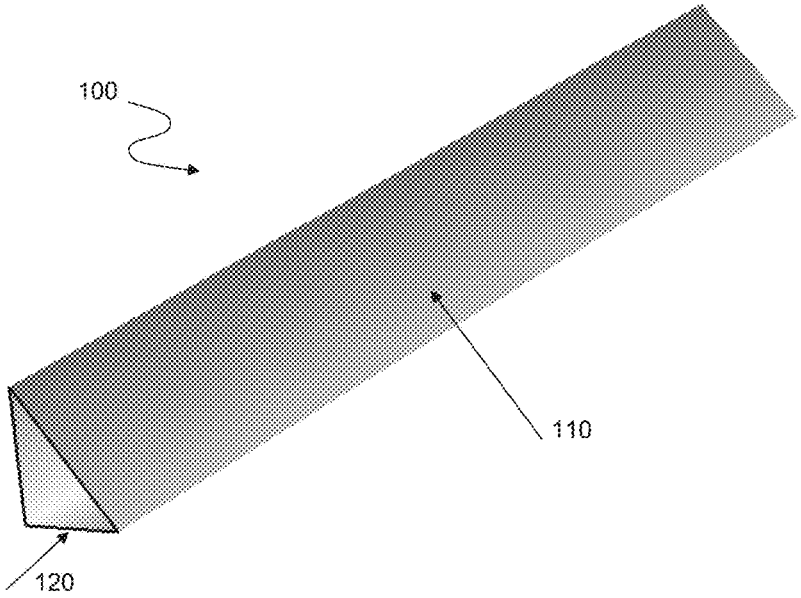
FIG. 4 illustrates an exemplary triangular cross-section of uniform size.

Similar reference numerals and designators in the various figures refer to like elements. The relative sizes, aspect ratios, rates of twist, fillet radii, number of passages, and other characteristics displayed in these figures are exemplary only, and can be varied without departing from the scope of the present subject matter.

DETAILED DESCRIPTION

The present subject matter relates to coolant passages 100 having non-circular cross-sections 120 with non-vaned swirl mechanisms. Although discussed below in the context of a nuclear reactor, the same principles also apply to chemical reactors and heat exchangers unless otherwise stated. In certain exemplary embodiments, passages 100 are formed by axial extrusion. A cross-section 120 of the passage 100 is extruded and rotated around an axis to form a twist in the passage wall 110. The rate of twist can be uniform, variable, or a combination of both. Variations can be smooth or incremental. Twist rate (or rate of twist 130) is defined as the axial distance in which a passage cross-section 120 angular orientation undergoes a 360 degree rotation, which can also be referred to as axial pitch.

Another exemplary manufacturing technique for forming coolant passages 100 is powder metal deposition. Powder metal deposition grows structural pieces through a layer build-up process. Another exemplary method of forming coolant passages 100 is manufacturing of blanks (not shown). One or more shaped blanks are combined to form one or more coolant passage 100. In certain exemplary embodiments, one or more blanks are arranged in an array (not shown) having a desired arrangement, with structural material (not shown), in liquid and/or powdered form around the blanks. The material is solidified to form the desired structure. In certain embodiments all or a portion of the blank material is removed (via mechanical, chemical, thermal/melting, or other processes), leaving a structure with the desired coolant passages 100.

Coolant passages 100 include a heat transfer surface area (the frictional area, e.g.) and a cross-sectional flow area. In certain embodiments, friction between the flowing coolant and a passage wall 110 contributes to pressure drop along the passage 100. In certain embodiments, heat transfer and frictional area are based at least in part on the perimeter of the cross-sectional shape of a passage 100, with flow area defined by the area of the passage cross-section 120. In still other embodiments, the area-to-perimeter ratio differs for different shapes (triangle, square, rectangle, and ellipsoid, for example). The variety of cross-sectional shapes provides flexibility in designing total heat transfer area and flow area, and in certain embodiments is used to influence heat transfer and/or pressure change. Other factors impacting heat transfer include but are not limited to the number of passages 100, relative metal-to-water ratio between passages 100, cross-sectional passage size, passage shape, passage frictional area vs. flow area, passage orientation, and relative angular offsets of neighboring passages 100.

Figure 5:
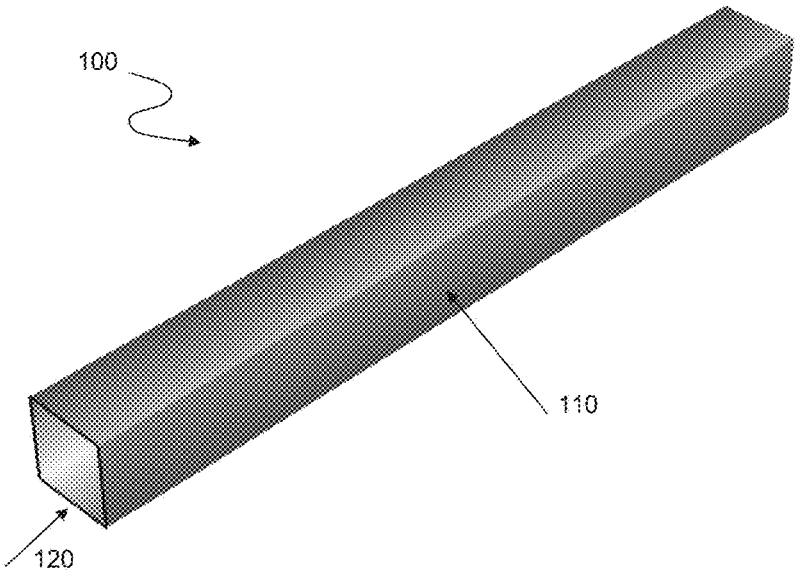
FIG. 5 illustrates an exemplary square cross-section of uniform size.
Figure 6:
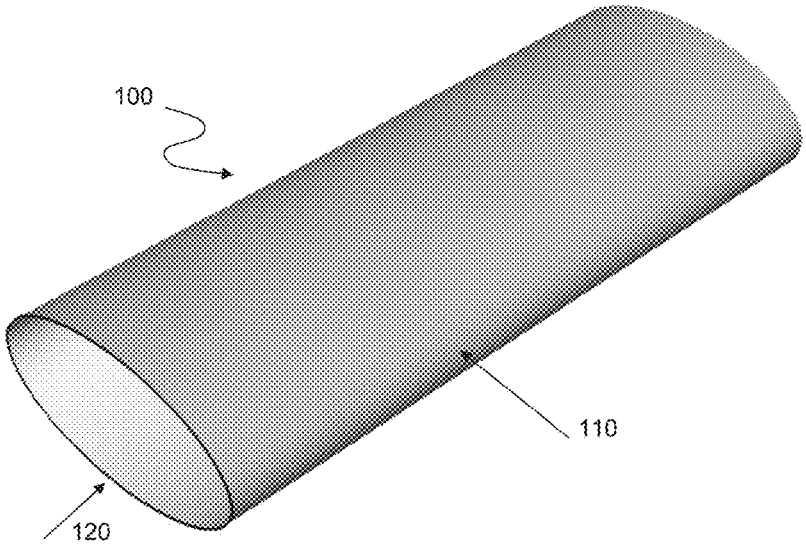
FIG. 6 illustrates an exemplary elliptical cross-section of uniform size.

One way to increase swirling flow in a passage is to use a non-circular cross-section, as shown in the exemplary coolant passages 100 of FIGS. 4-6. These non-circular coolant passage cross-sections 120 (triangular, square, rectangular, and ellipsoidal, for example), induce swirl 10. These shapes are exemplary only. Other non-circular passage cross-sections 120 can be used without departing from the scope of the present subject matter, as can passages employing multiple cross-section shapes in a passage 100.

Figure 7:
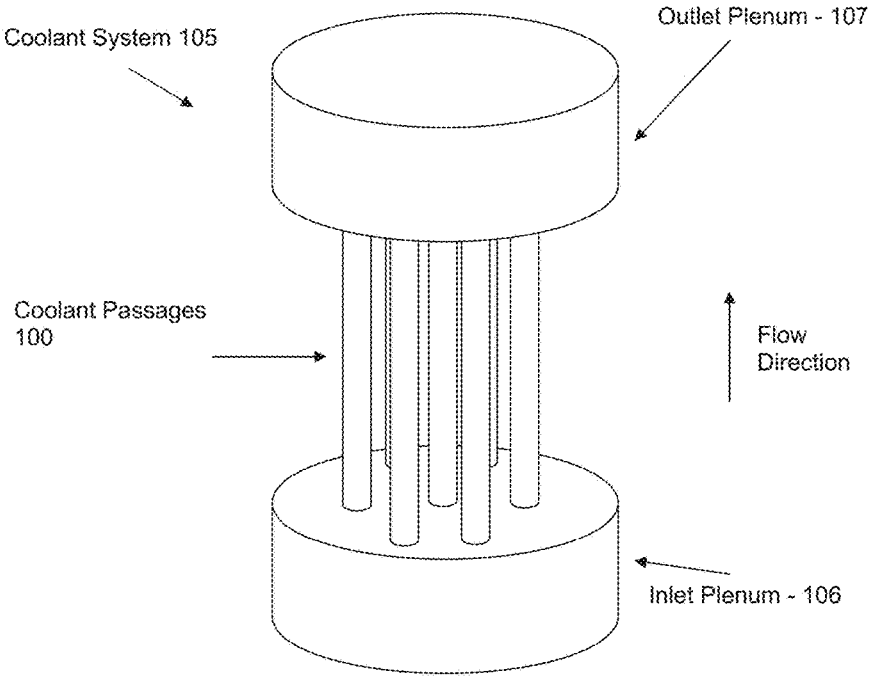
FIG. 7 illustrates an exemplary coolant system.

In certain embodiments, multiple passages 100 form a coolant system. FIG. 7 illustrates an exemplary coolant system 105 having an inlet plenum 106, an outlet plenum 107, and a plurality of non-circular coolant passages 100 connected in parallel between the inlet plenum 106 and the outlet plenum 107. Although not shown in the exemplary embodiment of FIG. 7, other exemplary embodiments include at least one passage wherein a cross-section size and/or an angular orientation of the passage cross-section vary uniformly, incrementally, and/or a combination of the two. Still other exemplary embodiments have at least one fillet defining at least one smooth finite radius of curvature between at least two adjoining passage walls.

Figure 8:
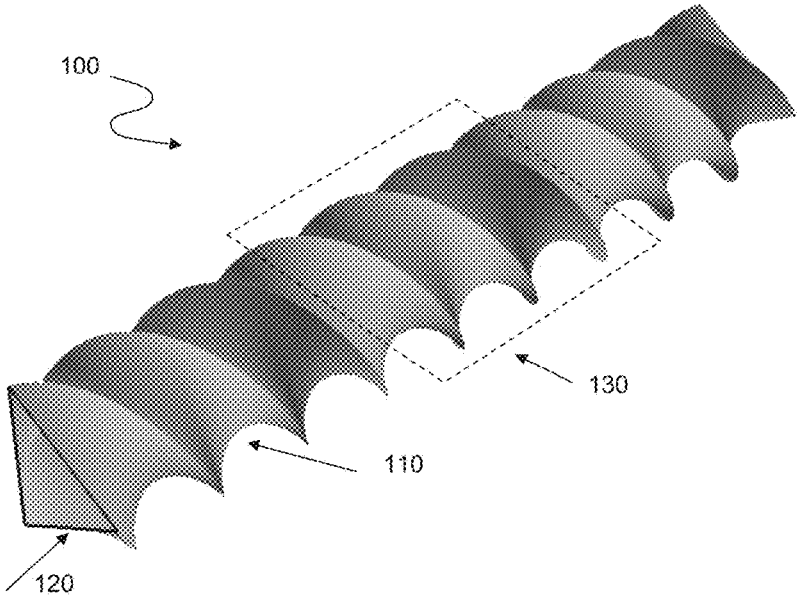
FIG. 8 illustrates an exemplary triangular cross-section of uniform size and uniform twist.
Figure 9:
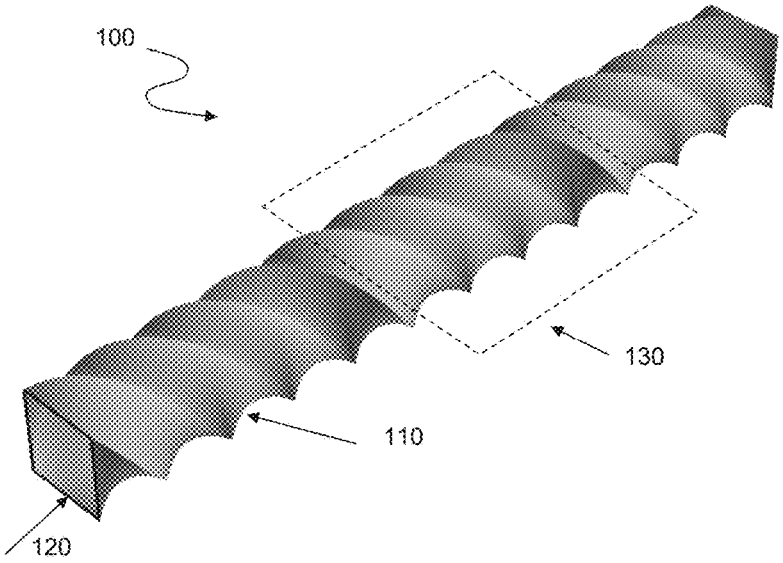
FIG. 9 illustrates an exemplary square cross-section of uniform size and uniform twist.
Figure 10:
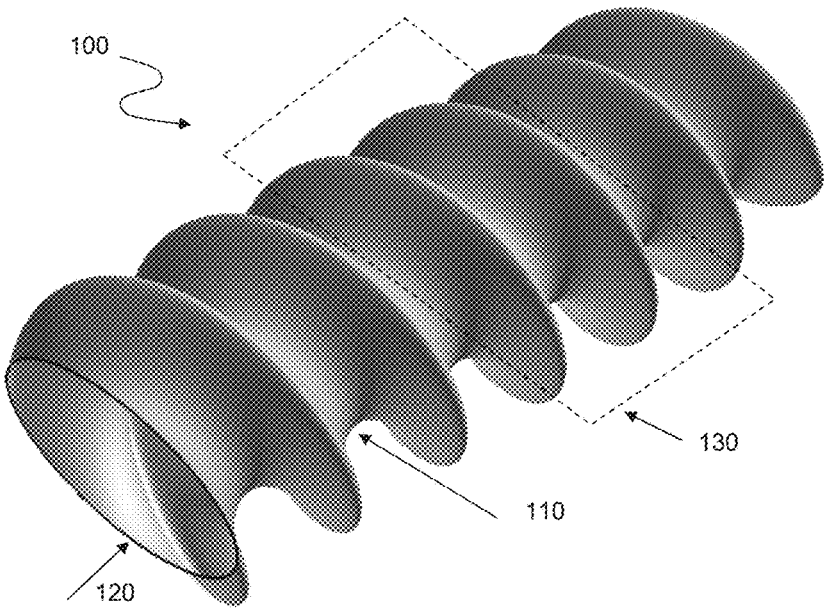
FIG. 10 illustrates an exemplary elliptical cross-section of uniform size and uniform twist.
Figure 11:
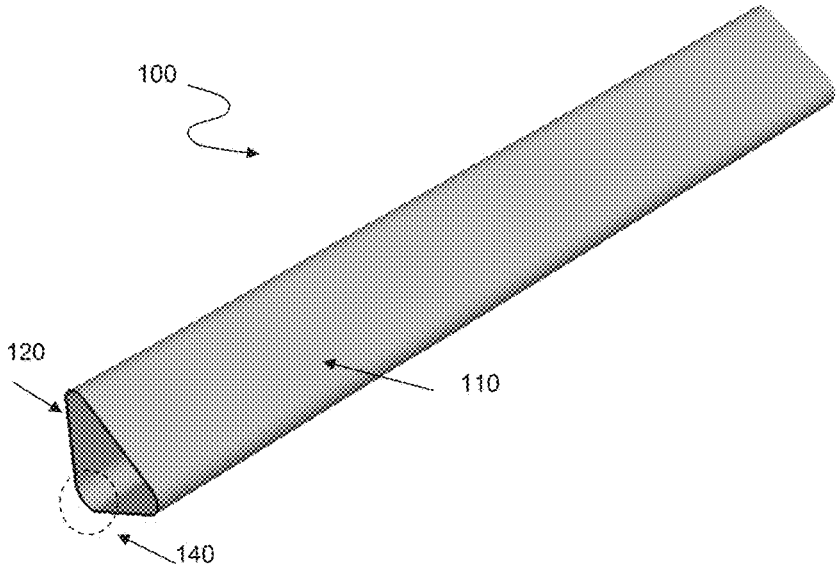
FIG. 11 illustrates an exemplary filleted triangular cross-section of uniform size.
Figure 12:
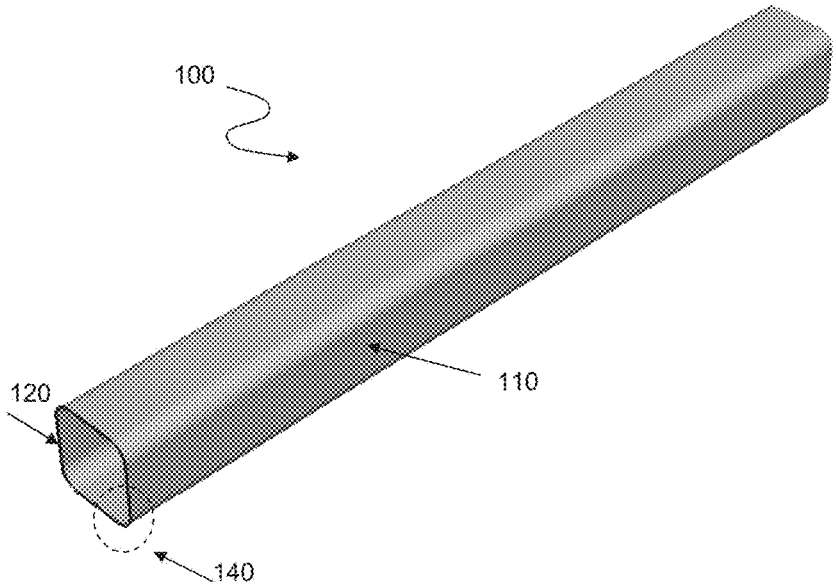
FIG. 12 illustrates an exemplary filleted square cross-section of uniform size.
Figure 13:
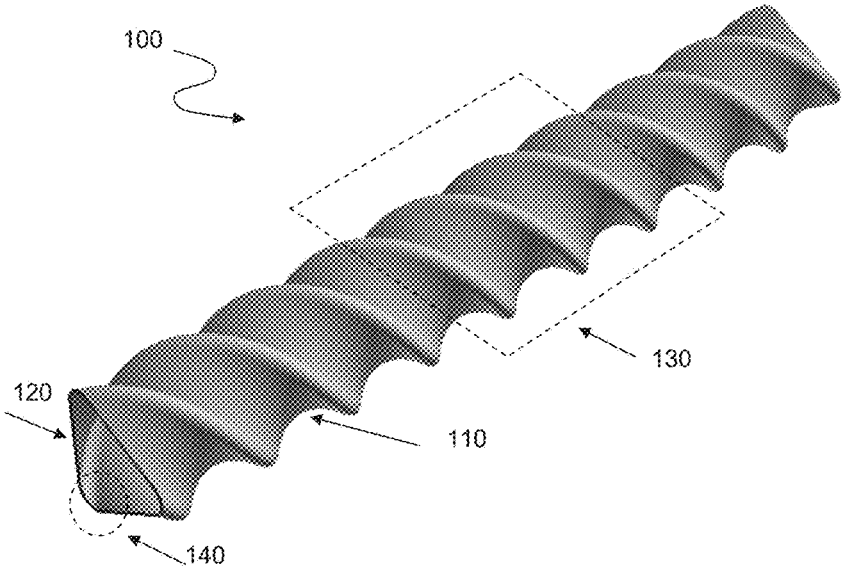
FIG. 13 illustrates an exemplary filleted triangular cross-section of uniform size and uniform twist.
Figure 14:
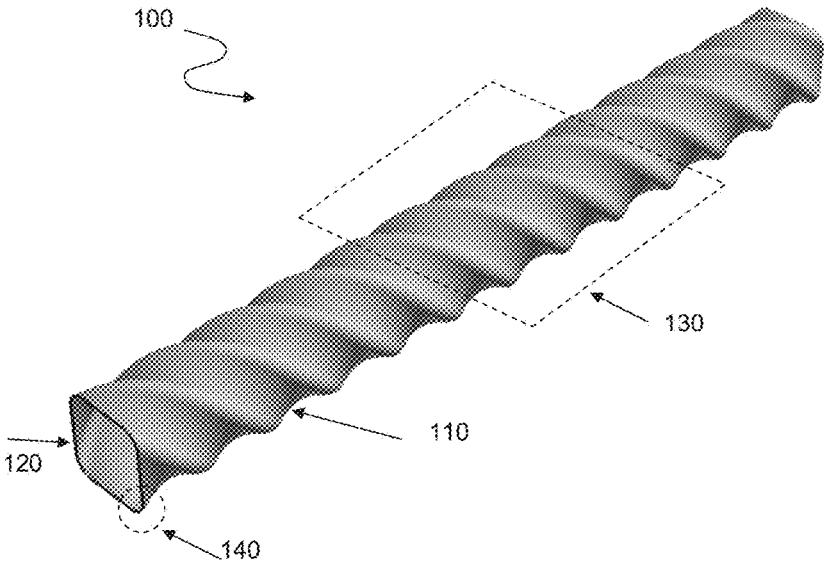
FIG. 14 illustrates an exemplary filleted square cross-section of uniform size and uniform twist.

FIGS. 8-10 illustrate exemplary passages 100 which increase swirl 10 by adding twist 130 to the passage cross-section 120. This twist 130 causes flowing coolant to swirl as it follows the passage walls 110, without vanes or rifling. The greater the rate of twist 130, the greater the coolant swirl 10. As discussed above, twist rate (also referred to as rate of twist 130) is defined as the axial distance in which a passage cross-section 120 angular orientation undergoes a 360 degree rotation. Twist rate can also be referred to as axial pitch. The smaller the axial pitch, the higher the rate of twist 130. Higher rates of twist 130 induce higher amounts of swirl 10. Increasing rate of twist 130 also increases passage heat transfer surface area, further increasing heat transfer.

Another way to increase heat transfer is to add at least one finite radius of curvature to an intersection of one or more passage walls 110. This finite radius of curvature is called a fillet 140. FIGS. 11-14 illustrate exemplary embodiments of coolant passages 100 with at least one fillet 140. A fillet 140 improves swirl 10 by eliminating geometric discontinuities (i.e., sharp corners), which inhibit swirl 10. A fillet 140 also improves heat transfer by increasing coolant passage 100 surface area, and helps reduce boundary layer build up in coolant passage corners. Although all of the passage corners shown in FIGS. 11-14 have fillets 140, fewer than all of the corners in a passage cross-section 120 can have a fillet 140 without departing from the scope of the present subject matter.

Another way to increase heat transfer effectiveness is to control a coolant passage 100 pressure change. Boiling flow coolant pressure, for example, can vary with respect to coolant flow rate, sometimes non-monotonically. Other factors known to those of skill in the art can also cause coolant pressure (boiling or otherwise) to vary and/or become unstable. If coolant pressure becomes unstable, net flow oscillations can occur in a coolant passage 100, causing coolant flow to become unstable. If coolant flow is unstable, heat transfer is unstable.

One way to mitigate this risk is to control where pressure changes occur or are likely to occur in a passage 100. In certain exemplary embodiments, coolant pressure in a passage 100 is controlled at least in part by varying the size of at least one coolant passage cross-section 120. In these exemplary embodiments, coolant pressure is controlled at least in part by controlling the size of a passage cross-section 120. Decreasing the size of the cross-section 120, for example, causes the coolant passage pressure gradient to increase. For a particular flow rate, the pressure gradient is proportional to the square of the velocity, with coolant velocity inversely proportional to the area of a passage cross-section 120. Passage cross-section area is proportional to the square of the hydraulic diameter (defined as four times the area of a passage cross-section 120 divided by the passage wetted perimeter). By reducing the hydraulic diameter near the bottom of a vertical boiling flow coolant passage 100 (by reducing the size passage cross-section 120, for example) coolant flow stability is increased because more of the pressure drop occurs lower in the passage 100. To reduce pressure drop in a passage 100, the size of the passage cross-section 120 can be increased.

Figure 15:
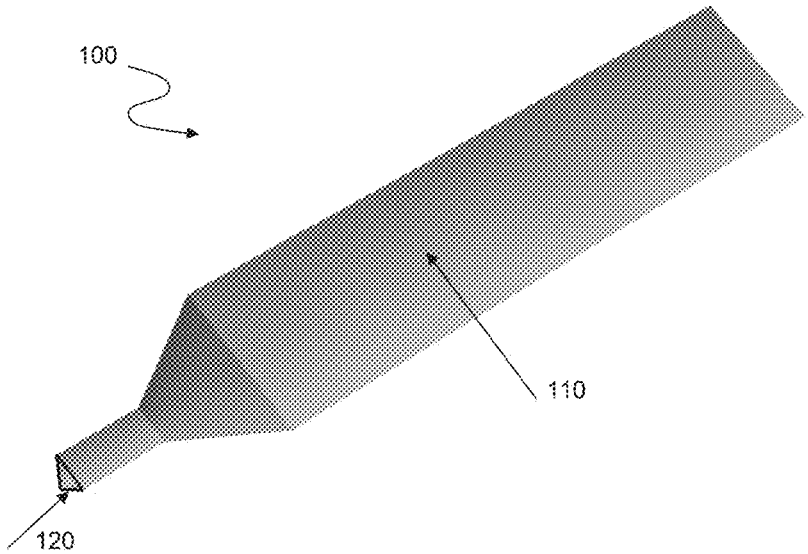
FIG. 15 illustrates an exemplary triangular cross-section with segmented size variation.
Figure 16:
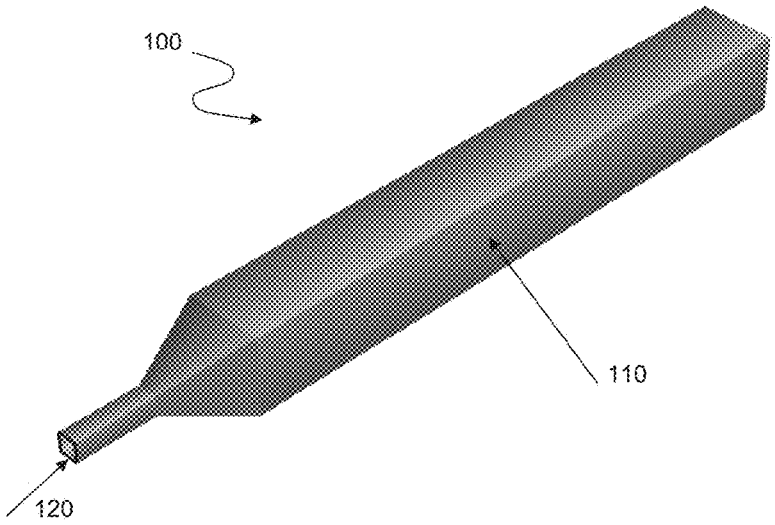
FIG. 16 illustrates an exemplary square cross-section with segmented size variation.
Figure 17:
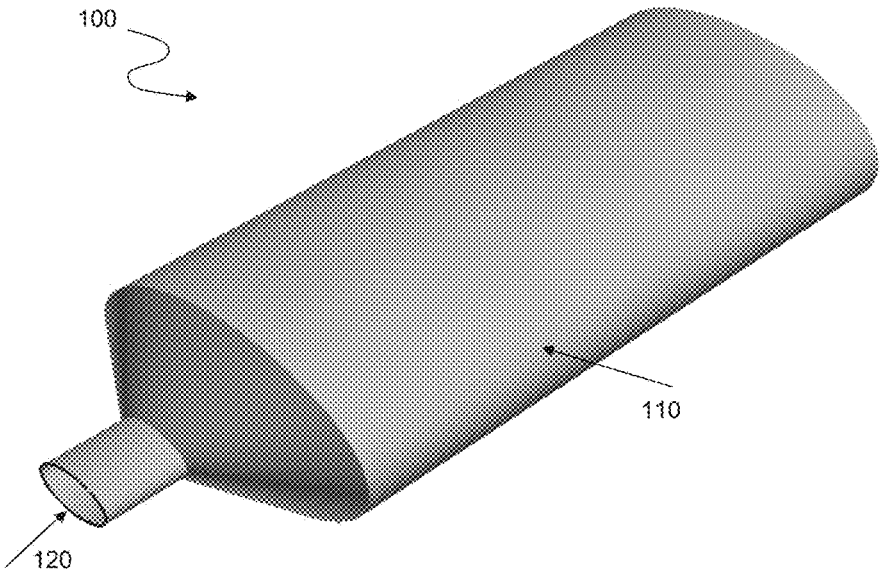
FIG. 17 illustrates an exemplary elliptical cross-section with segmented size variation.
Figure 18:
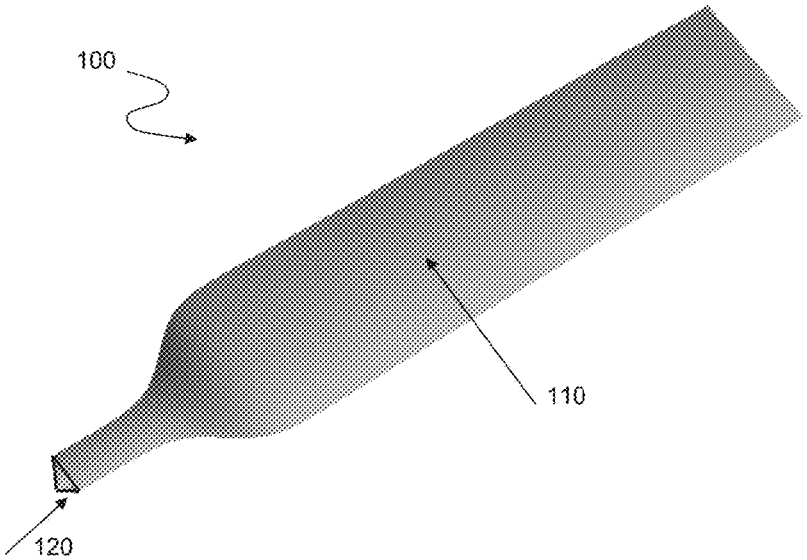
FIG. 18 illustrates an exemplary triangular cross-section of smoothly varying size.
Figure 19:
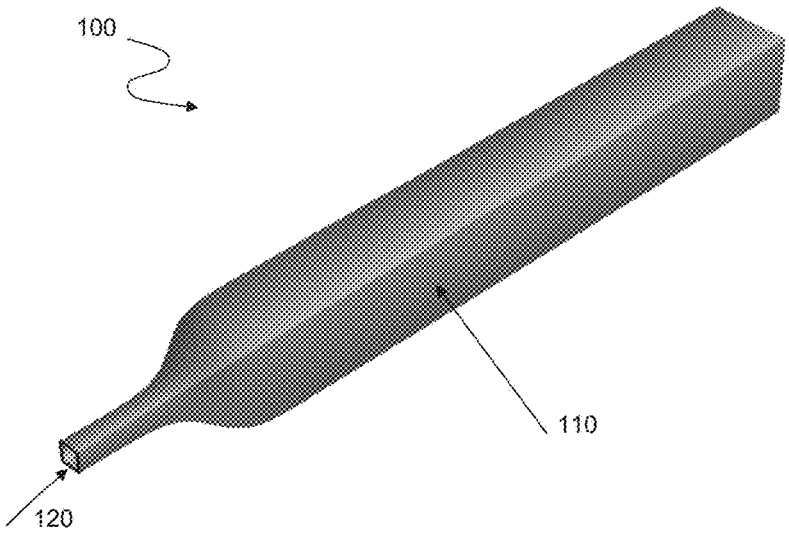
FIG. 19 illustrates an exemplary square cross-section of smoothly varying size.
Figure 20:
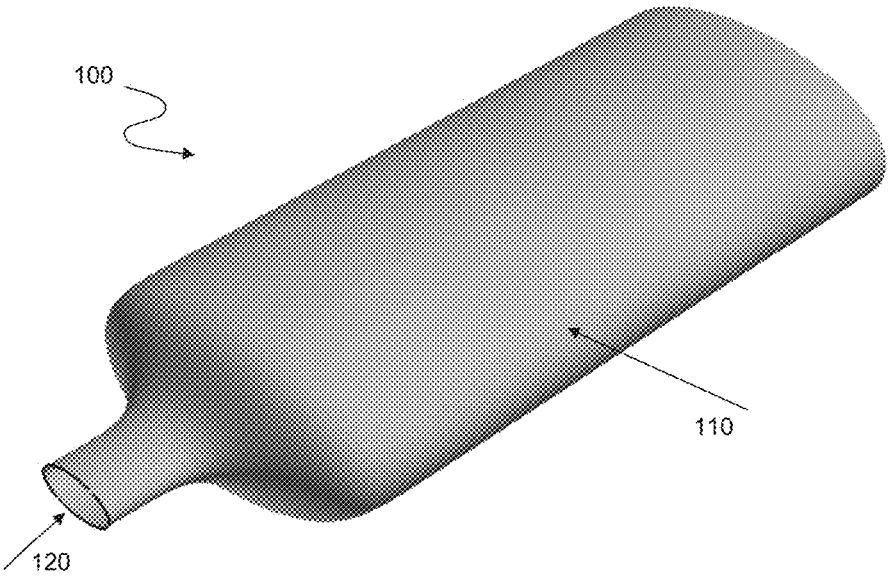
FIG. 20 illustrates an exemplary elliptical cross-section of smoothly varying size.
Figure 21:
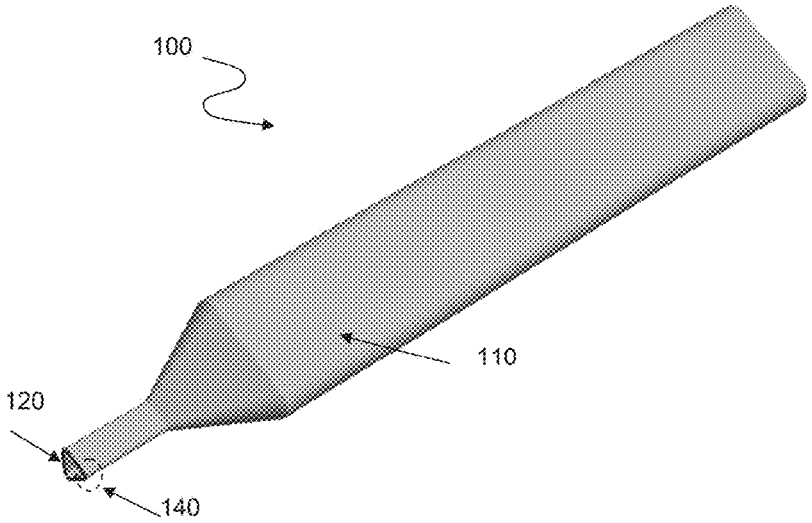
FIG. 21 illustrates an exemplary filleted triangular cross-section with segmented size variation.
Figure 22:
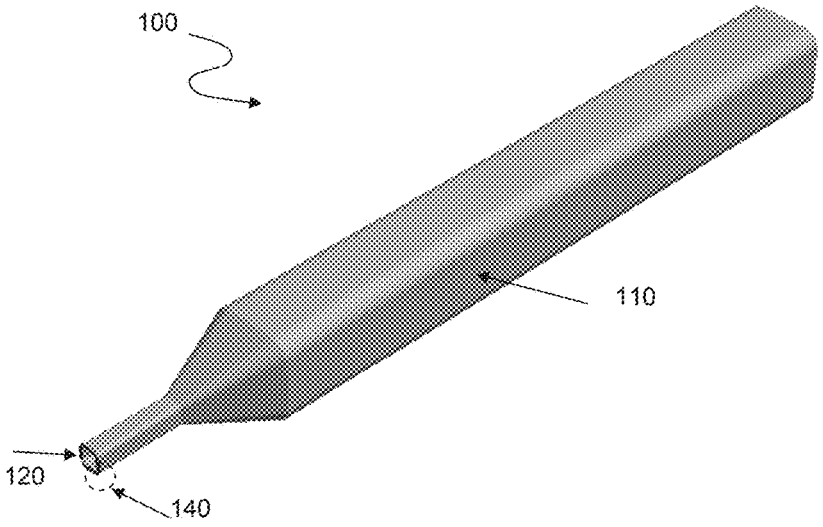
FIG. 22 illustrates an exemplary filleted square cross-section with segmented size variation.
Figure 23:
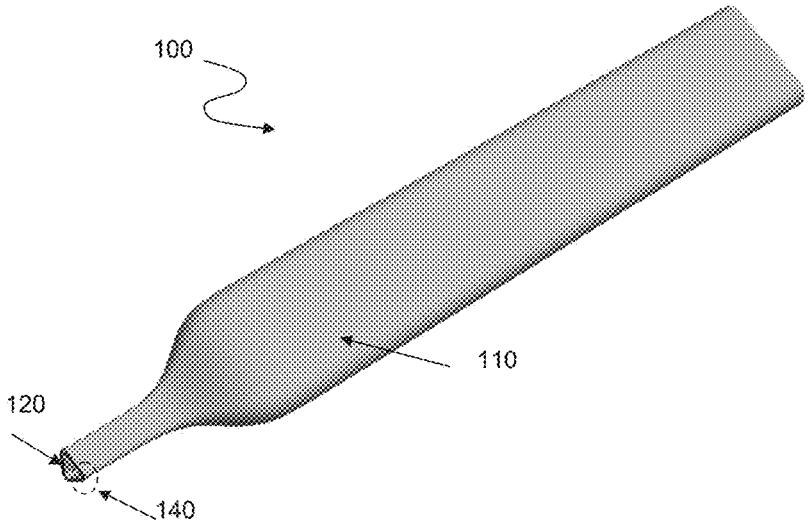
FIG. 23 illustrates an exemplary filleted triangular cross-section of smoothly varying size.
Figure 24:
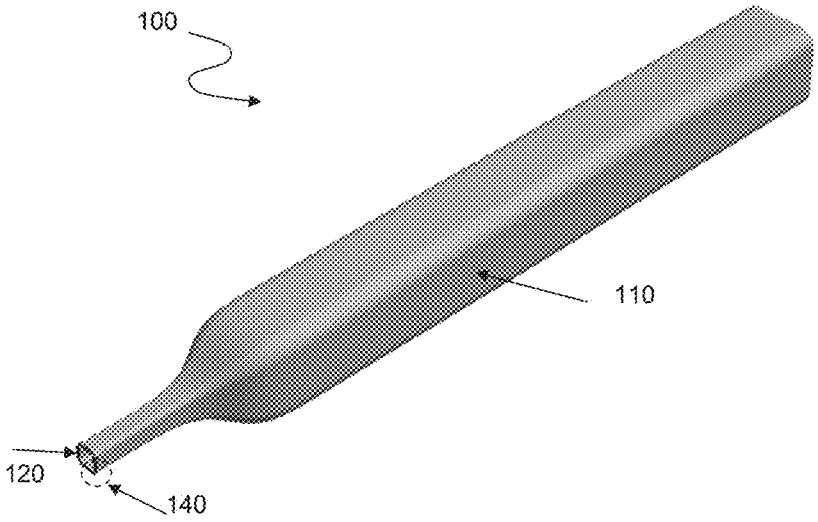
FIG. 24 illustrates an exemplary filleted square cross-section of smoothly varying size.

FIGS. 15-24 illustrate coolant passages 100 with cross-sections 120 of varying size. The change in size can be incremental (segmented), smooth, or a combination of both. This variance improves performance by locating at least one pressure drop in at least one preferred location along the axial length of a passage 100, with a larger pressure drop in regions of smaller cross-section size. FIGS. 15-17 illustrate exemplary embodiments with incremental (segmented) variations in the cross-section size. FIGS. 18-20 illustrate exemplary embodiments which add smooth variations to one or more passage cross-sections 120. FIGS. 21 and 22 illustrate exemplary embodiments having incremental (or segmented) variations in cross-section size, with one or more fillets 140 in the coolant passages 100. FIGS. 23 and 24 illustrate exemplary embodiments having smooth variations in the cross-section size, with one or more fillets 140 in the coolant passages 100.

Pressure change can also be controlled at least in part by varying the rate of twist 130 in a passage 100. Heat transfer can also be controlled at least in part by varying the rate of twist 130. Increasing the rate of twist 130 increases the frictional area seen by the coolant in a passage 100, which increases flow resistance, causing coolant pressure drop to be larger in regions of greater twist 130. Coolant flow stability can be improved by locating areas of increased rate of twist 130 in areas where a pressure drop is desired. The change in passage rate of twist 130 can be incremental, smooth, or a combination of both. Areas of increased rate of twist 130 can also be located where increased heat transfer is desired. These areas can, but need not be, co-located with areas where a pressure change is desired.

Figure 25:
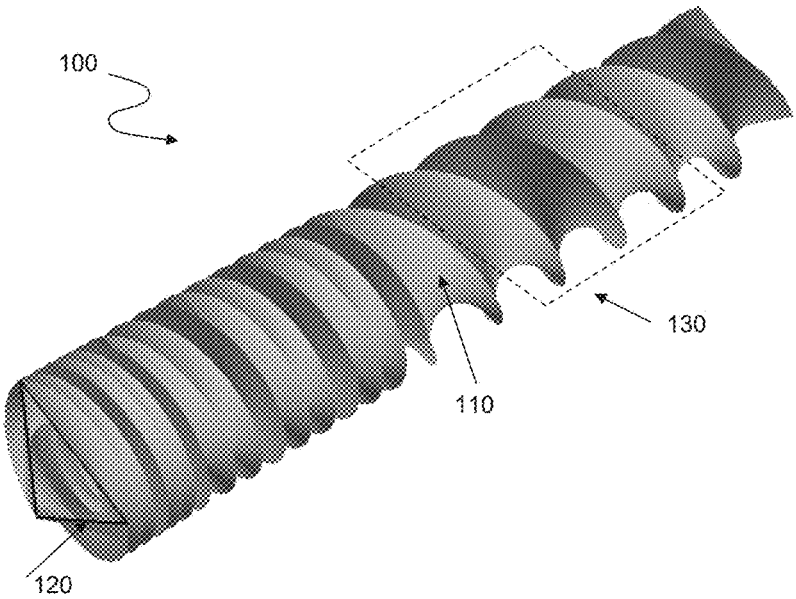
FIG. 25 illustrates an exemplary triangular cross-section of uniform size and segment-varying twist.
Figure 26:
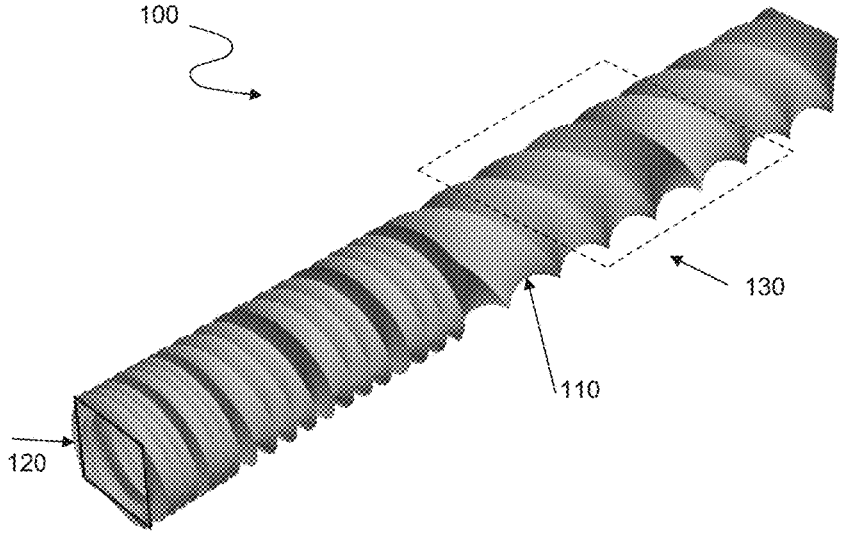
FIG. 26 illustrates an exemplary square cross-section of uniform size and segment-varying twist.
Figure 27:
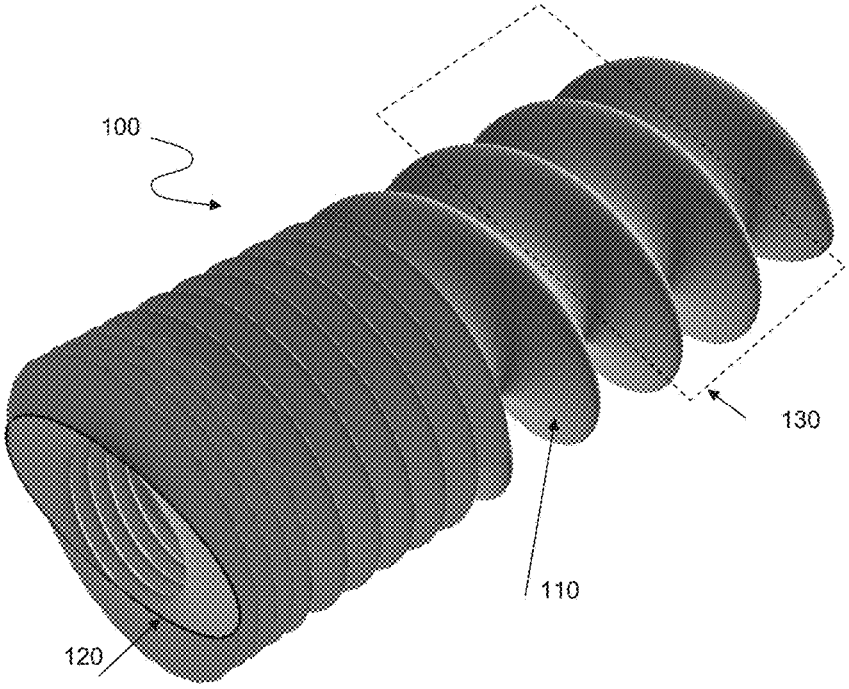
FIG. 27 illustrates an exemplary elliptical cross-section of uniform size and segment-varying twist.
Figure 28:
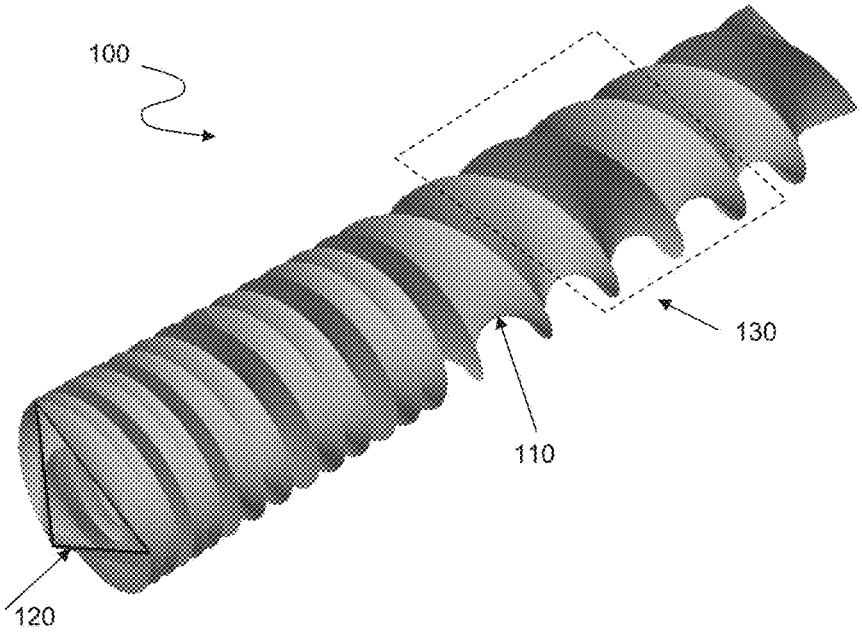
FIG. 28 illustrates an exemplary triangular cross-section of uniform size and smoothly varying twist.
Figure 29:
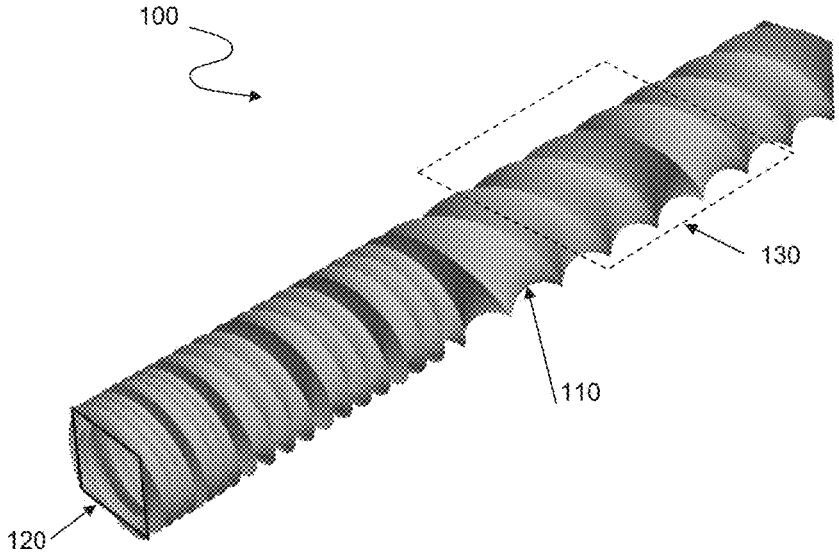
FIG. 29 illustrates an exemplary square cross-section of uniform size and smoothly varying twist.
Figure 30:
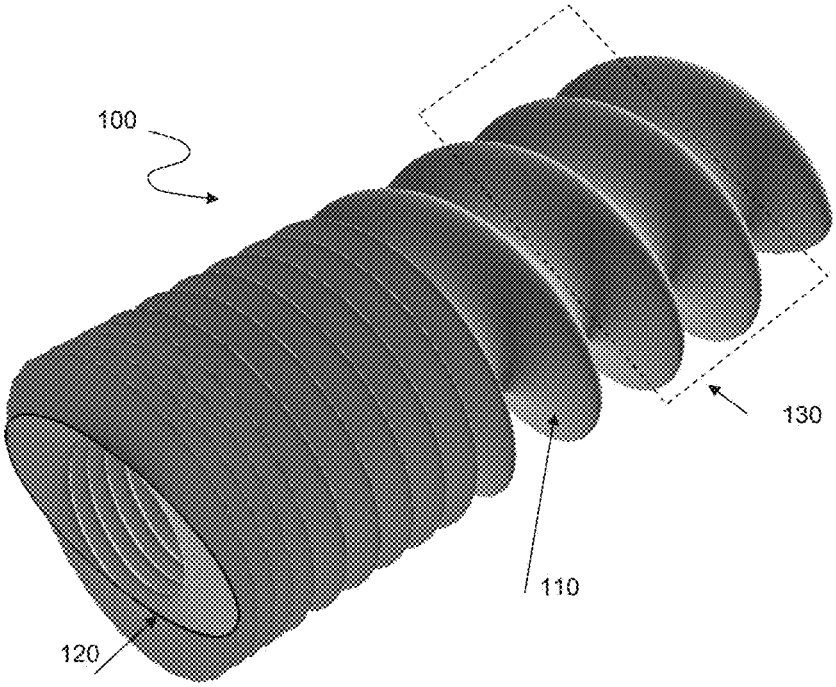
FIG. 30 illustrates an exemplary elliptical cross-section of uniform size and smoothly varying twist.
Figure 31:
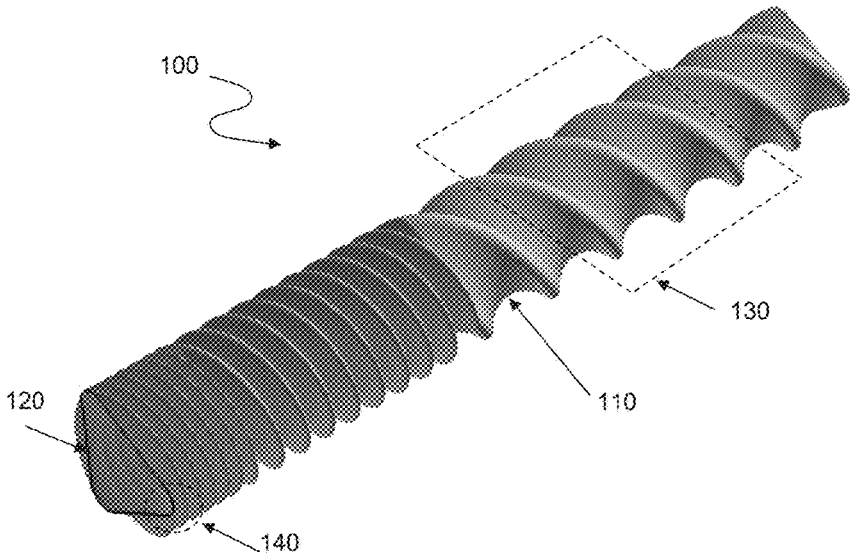
FIG. 31 illustrates an exemplary filleted triangular cross-section of uniform size and segment-varying twist.
Figure 32:
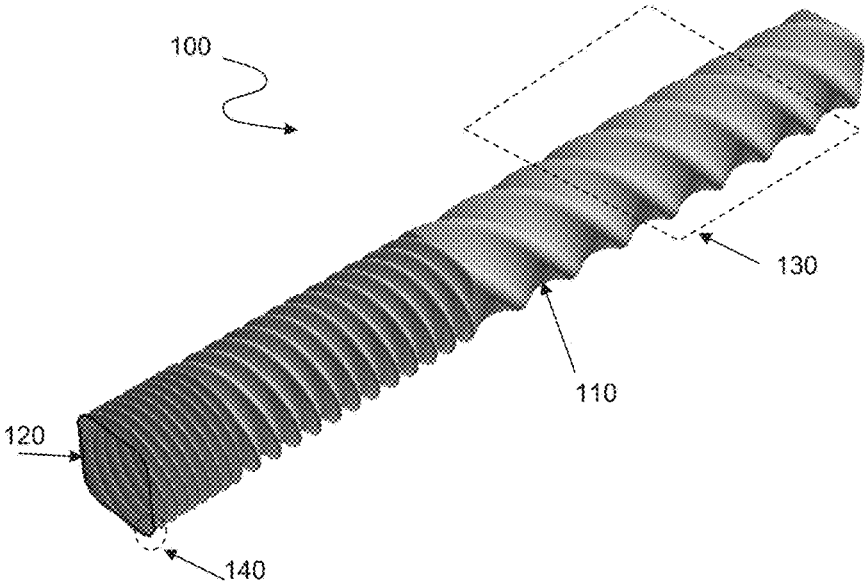
FIG. 32 illustrates an exemplary filleted square cross-section of uniform size and segment-varying twist.
Figure 33:
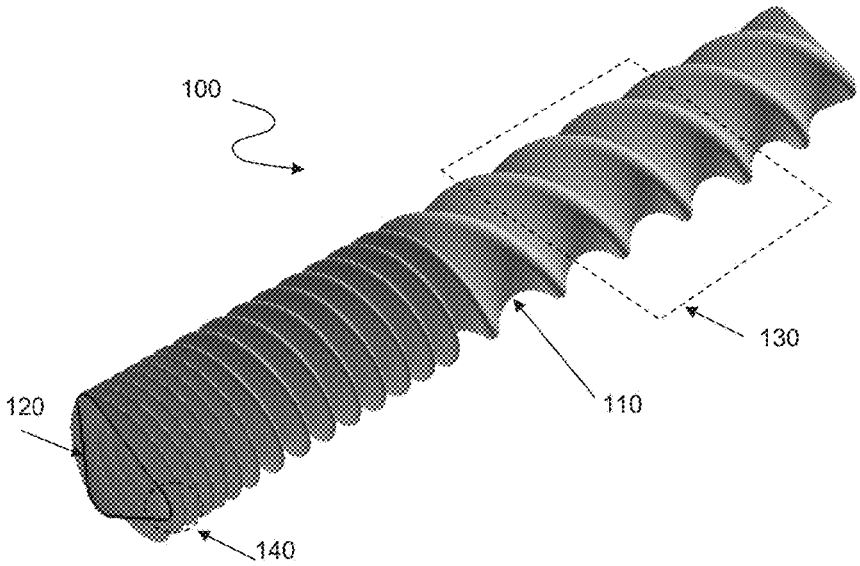
FIG. 33 illustrates an exemplary filleted triangular cross-section of uniform size and smoothly varying twist.
Figure 34:
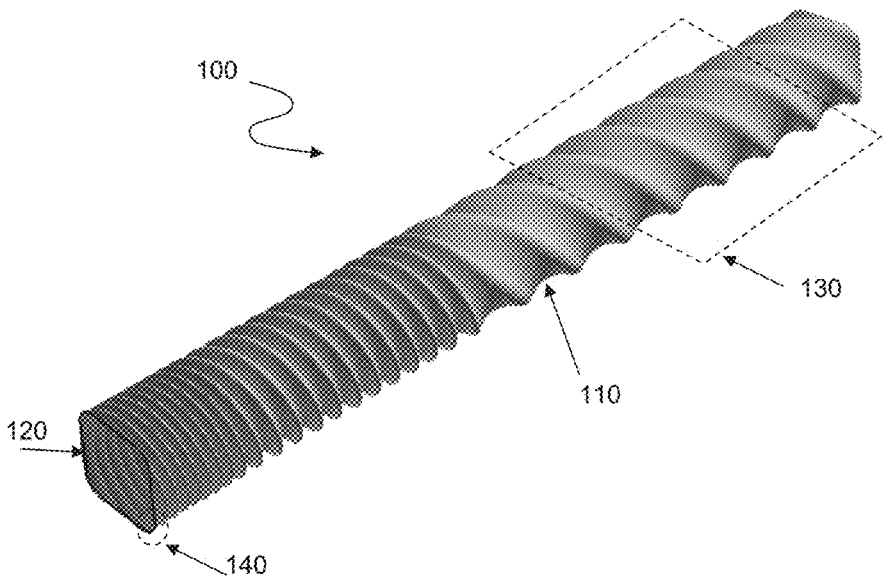
FIG. 34 illustrates an exemplary filleted square cross-section of uniform size and smoothly varying twist.

FIGS. 25-34 illustrate exemplary embodiments where heat transfer is improved by locating at least one area of higher rate of twist 130 in at least one area where higher heat transfer is desired, and/or where a pressure change is desired. FIGS. 25-27 illustrate exemplary embodiments adding incremental (segmented) variations in rate of twist 130 to the coolant passages 100. FIGS. 28-30 illustrate exemplary embodiments adding smooth variations in rate of twist 130 to the coolant passages 100. FIGS. 31 and 32 illustrate exemplary embodiments adding incremental (segmented) variations in rate of twist 130 with at least one fillet 140 included in the coolant passages 100. FIGS. 33 and 34 illustrate exemplary embodiments adding smooth variations in rate of twist 130 to with at least one fillet 140 included in the coolant passages 100.

Figure 35:
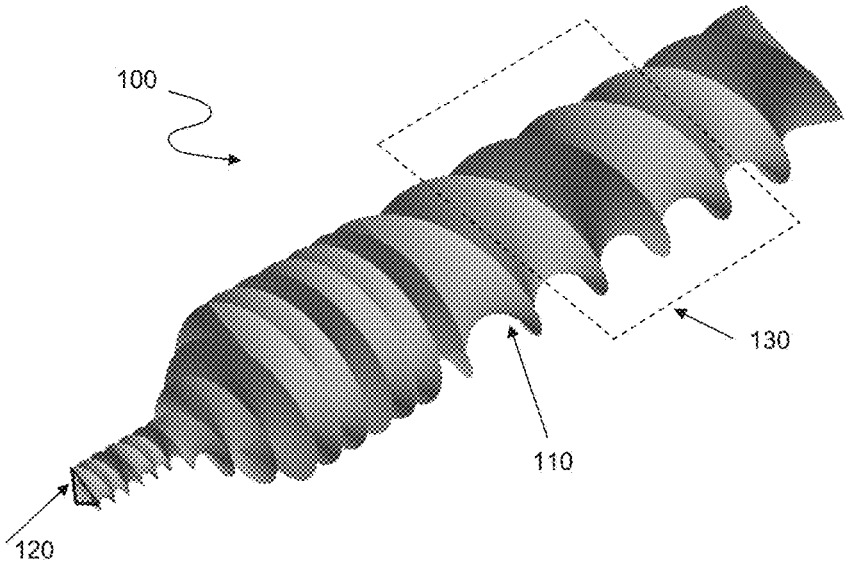
FIG. 35 illustrates an exemplary triangular cross-section with segmented size variation and segment-varying twist.
Figure 36:
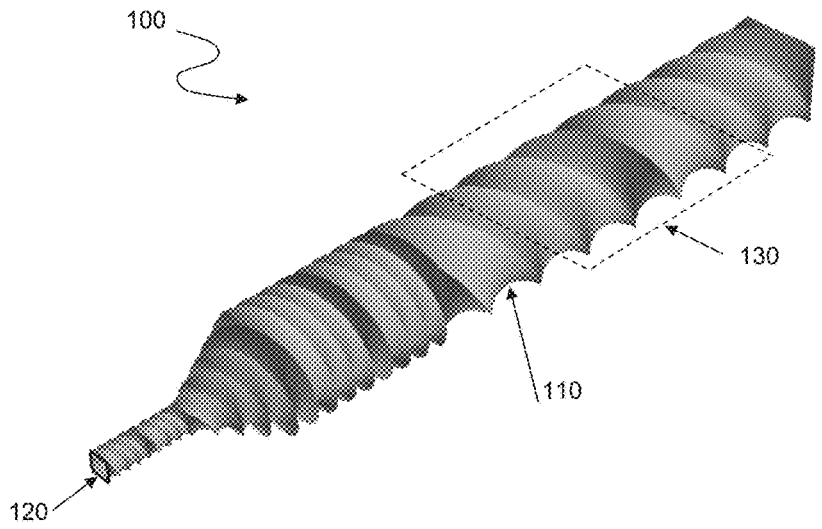
FIG. 36 illustrates an exemplary square cross-section with segmented size variation and segment-varying twist.
Figure 37:
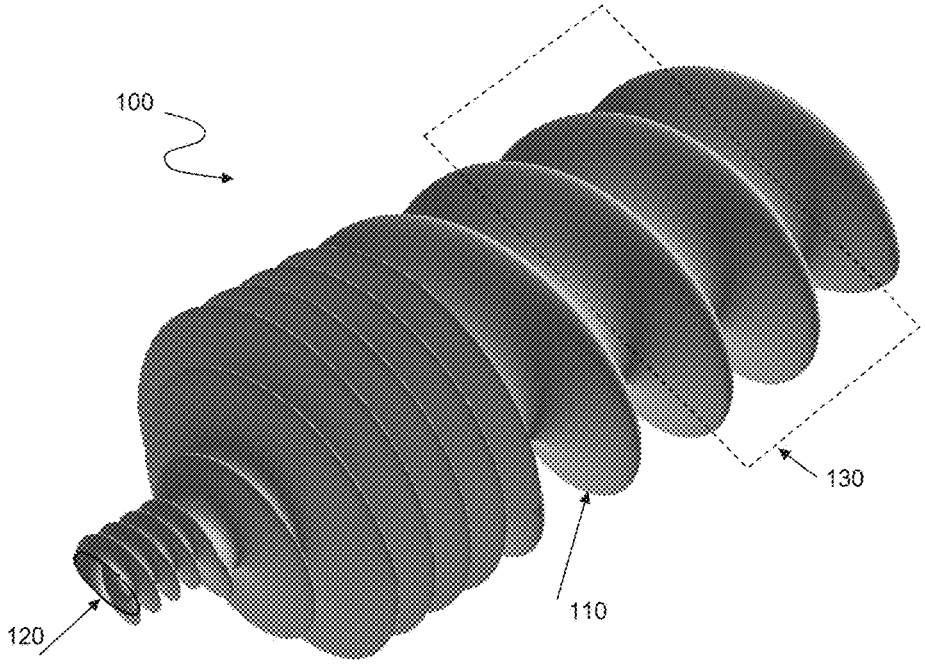
FIG. 37 illustrates an exemplary elliptical cross-section with segmented size variation and segment-varying twist.
Figure 38:
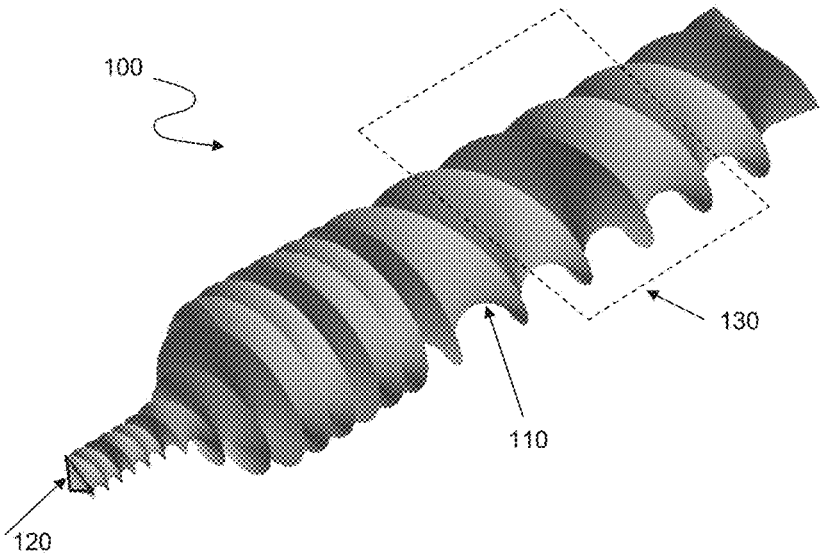
FIG. 38 illustrates an exemplary triangular cross-section of smoothly varying size and smoothly varying twist.
Figure 39:
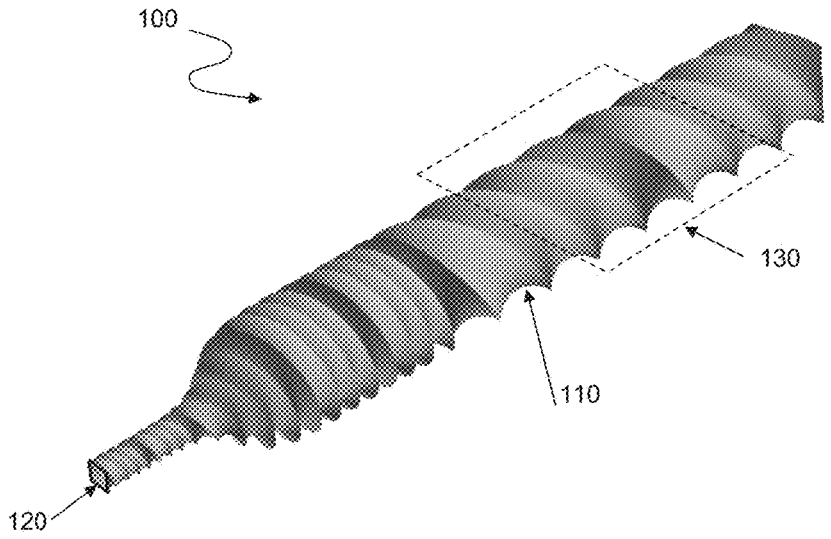
FIG. 39 illustrates an exemplary square cross-section of smoothly varying size and smoothly varying twist.
Figure 40:
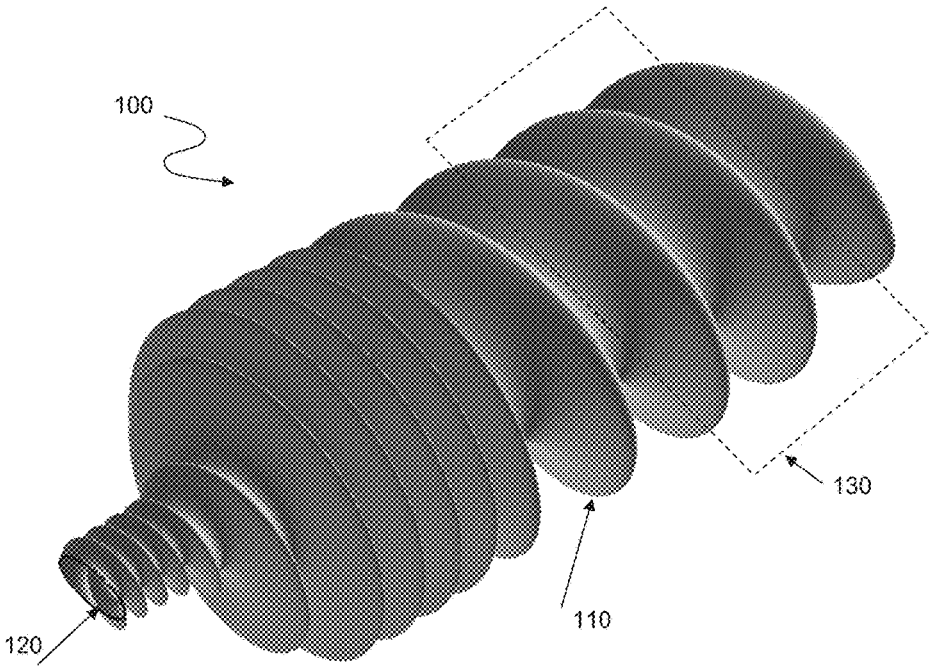
FIG. 40 illustrates an exemplary elliptical cross-section of smoothly varying size and smoothly varying twist.
Figure 41:
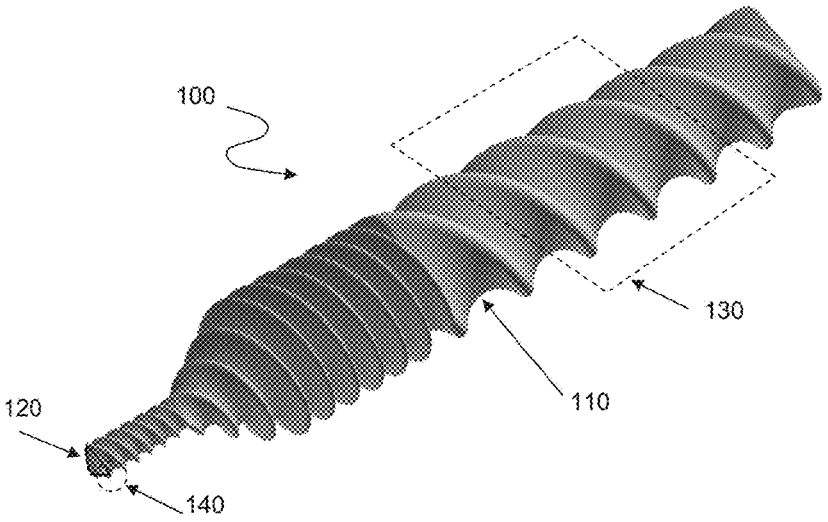
FIG. 41 illustrates an exemplary filleted triangular cross-section with segmented size variation and segment-varying twist.
Figure 42:
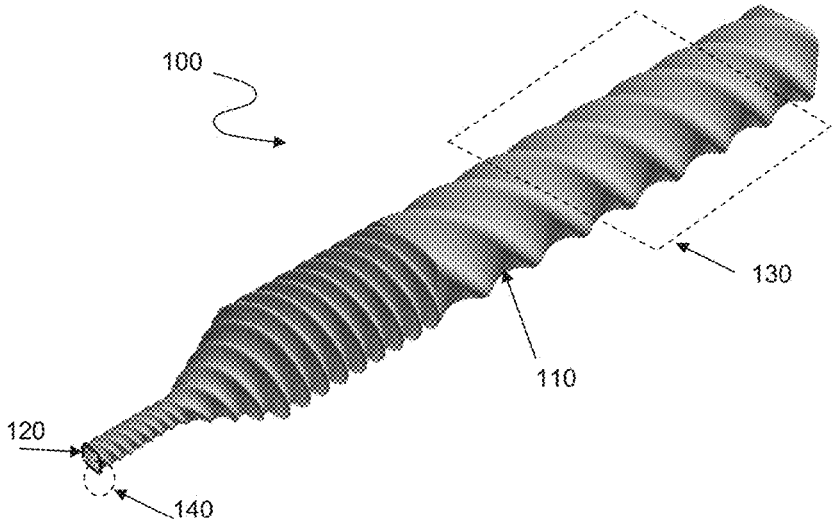
FIG. 42 illustrates an exemplary filleted square cross-section with segmented size variation and segment-varying twist.
Figure 43:
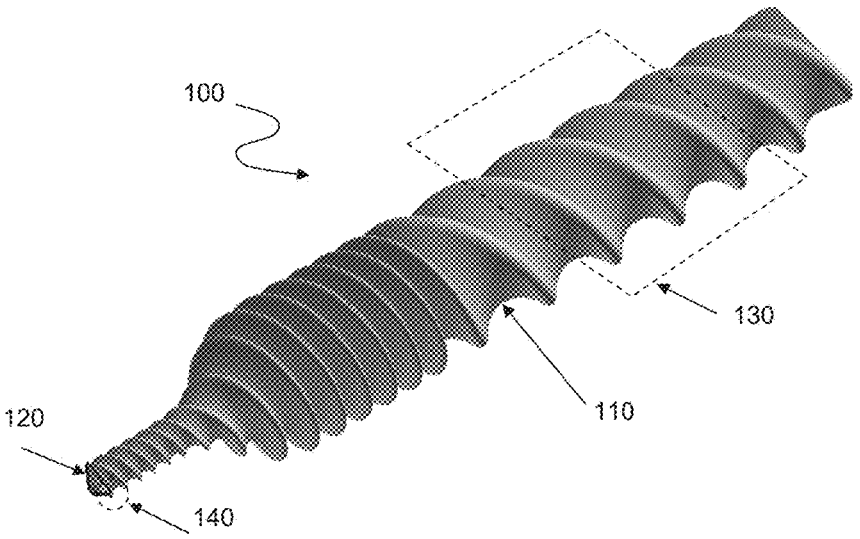
FIG. 43 illustrates an exemplary filleted triangular cross-section of smoothly varying size and smoothly varying twist.
Figure 44:
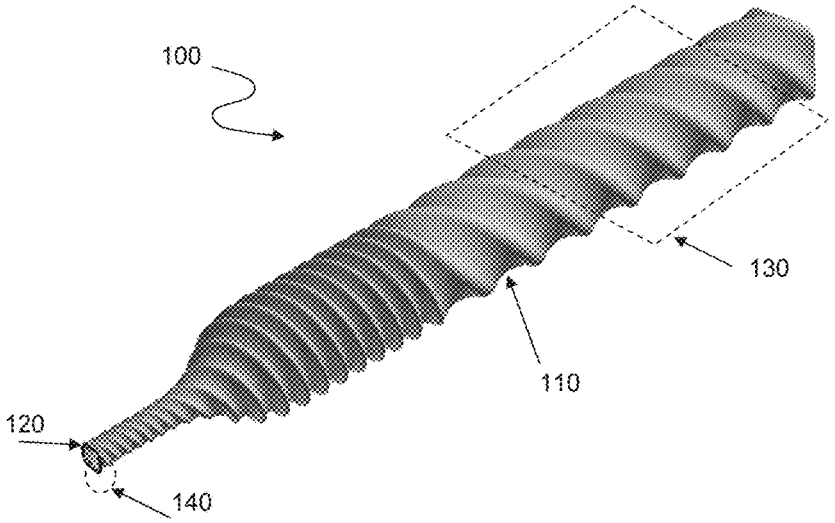
FIG. 44 illustrates an exemplary filleted square cross-section of smoothly varying size and smoothly varying twist.

In certain exemplary coolant passages 100, an axial variation in a cross-section 120 is combined with an axial variation in rate of twist 130. Variations in size and/or twist 130 can be incremental, smooth, and/or a combination of both. FIGS. 35-37 illustrate exemplary coolant passages 100 having incremental (segmented) variations in size of a cross-section 120 and incremental (segmented) variations in twist 130. FIGS. 38-40 illustrate exemplary coolant passages 100 having smooth variations in size of a cross-section 120 and smooth variations in twist 130. FIGS. 41 and 42 illustrate exemplary coolant passages 100 having incremental (segmented) variations in size of a cross-section 120 and incremental (segmented) variations in twist 130 and at least one fillet 140. FIGS. 43 and 44 illustrate exemplary coolant passages 100 having smooth variations in size of a cross-section 120 and smooth variations in twist 130 and at least one fillet 140. These configurations are exemplary only, and not limiting to the present subject matter. Other exemplary embodiments can include smooth variation in size with incremental variation in the twist rate, and vice-versa, without departing from the scope of the present subject matter.

In certain exemplary embodiments, multiple passages 100 are grouped together to form a cell 200. A cell 200 is a group of passages 100 oriented around a common reference point called a centroid 210. The centroid 210 need not be in the center of a cell 200. Cells 200 are described based on their relative orientation of the passages to each other, known as their cellular pitch 220. For example, a cell 200 with passages 100 arranged in a triangular formation has a triangular cellular pitch 220. A cell 200 with passages arranged in a square formation has a square cellular pitch 220, and a cell 200 with a passages 100 arranged in a hexagonal formation has a hexagonal cellular pitch 220. Cellular pitches of other shapes can be used without departing from the scope of the present subject matter.

Figure 45:
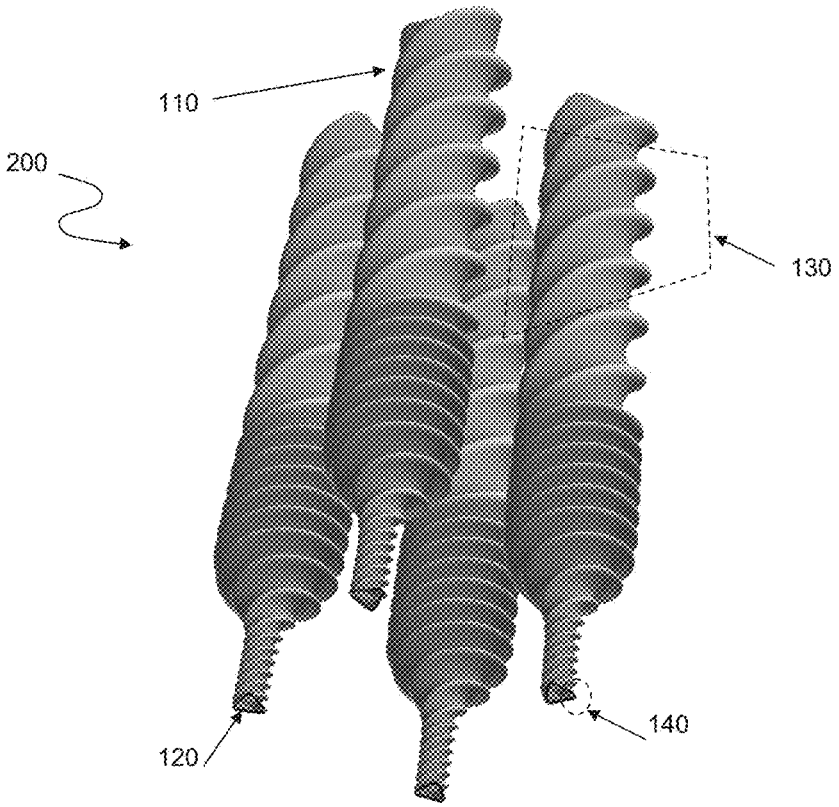
FIG. 45 illustrates an exemplary cell in a square cellular pitch with passages having filleted triangular cross-sections of smoothly varying size and smoothly varying twist.
Figure 46:
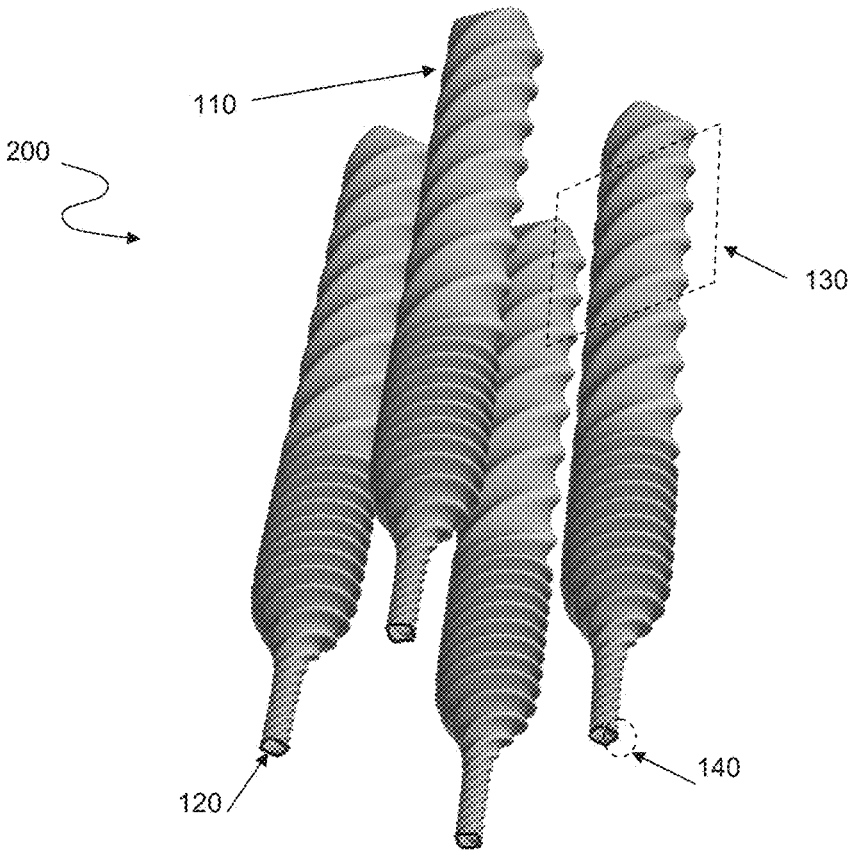
FIG. 46 illustrates an exemplary cell in a square cellular pitch with passages having filleted square cross-sections of smoothly varying size and smoothly varying twist.
Figure 47:
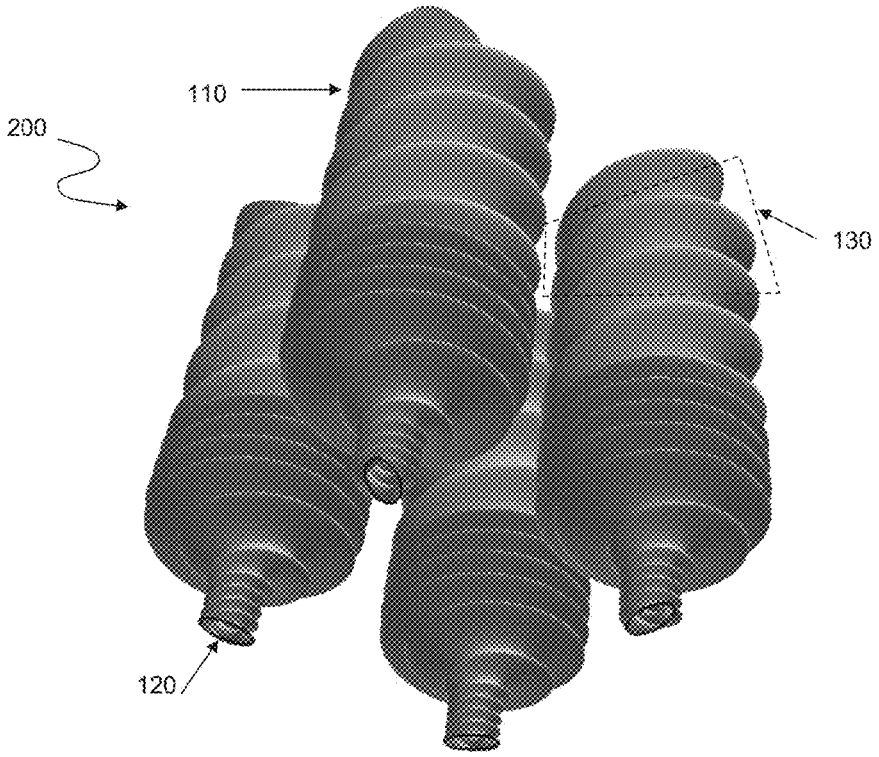
FIG. 47 illustrates an exemplary cell in a square cellular pitch with passages having elliptical cross-sections of smoothly varying size and smoothly varying twist.

FIGS. 45-47 illustrate exemplary cells 200 in a square cellular pitch 220. In FIG. 45, the passages 100 in exemplary cell 200 have passages 100 with triangular cross-sections 120 of smoothly varying size, with smoothly varying twist 130 and at least one fillet 140. In FIG. 46, the passages 100 in exemplary cell 200 have square cross-sections 120 of smoothly varying size, with smoothly varying twist 130 and at least one fillet 140. In FIG. 47, the passages 100 in exemplary cell 200 have elliptical (ellipsoidal) cross-sections 120 of smoothly varying size, with smoothly varying twist 130. Other cellular pitches and passage cross-sectional shapes can be used without departing from the scope of the present subject matter, as can the number of passages 100 and cells 200.

Figure 48:
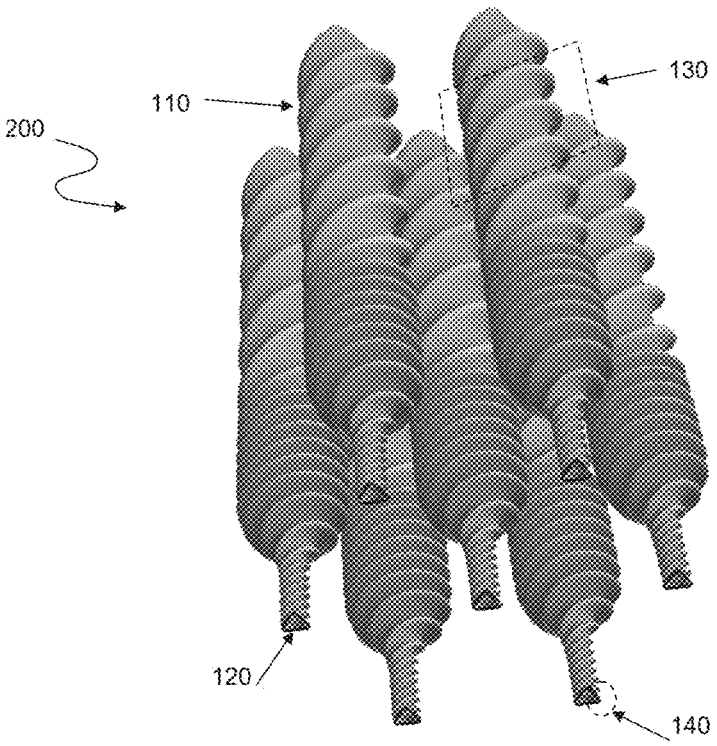
FIG. 48 illustrates an exemplary cell in a triangular cellular pitch with passages having filleted triangular cross-sections of smoothly varying size and smoothly varying twist.
Figure 49:
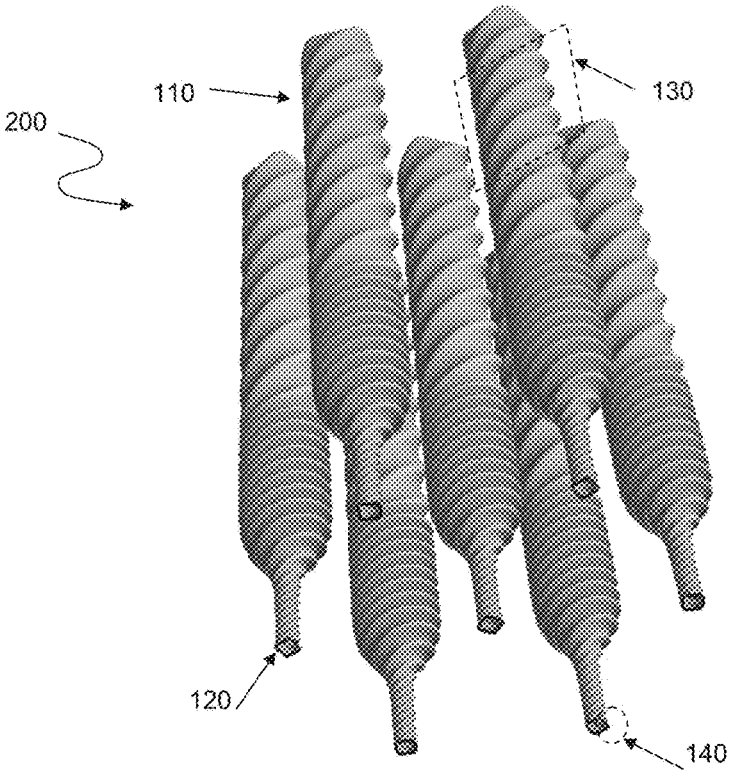
FIG. 49 illustrates an exemplary cell in a triangular cellular pitch with passages having filleted square cross-sections of smoothly varying size and smoothly varying twist.
Figure 50:
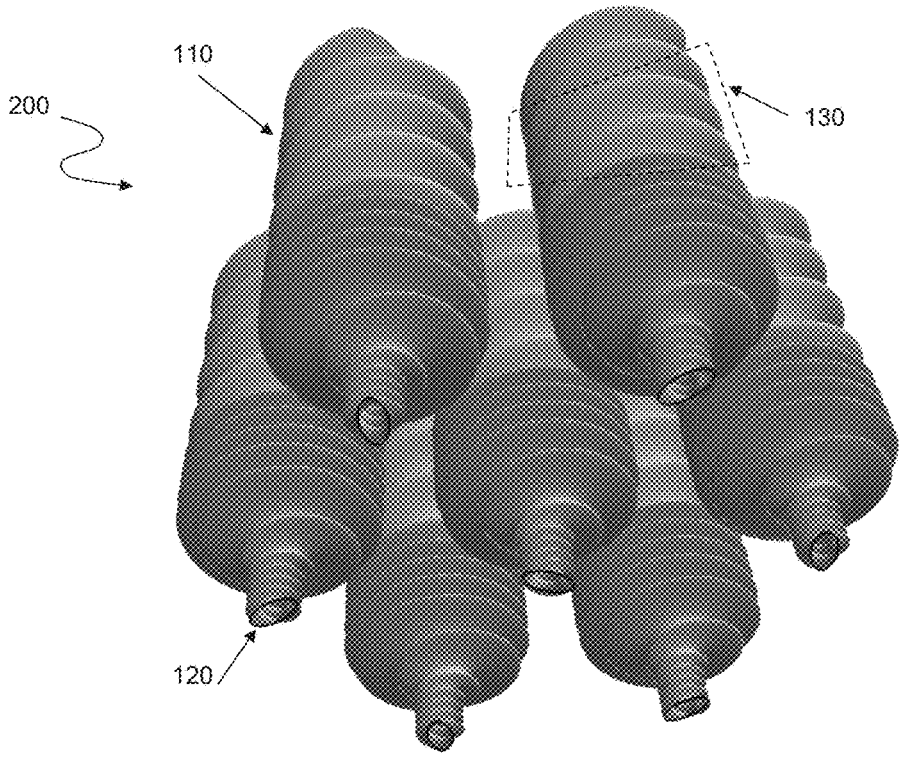
FIG. 50 illustrates an exemplary cell in a triangular cellular pitch with passages having elliptical cross-sections of smoothly varying size and smoothly varying twist.

FIGS. 48-50 illustrate exemplary cells 200 in a triangular cellular pitch 220. In FIG. 48, the passages 100 in exemplary cell 200 have triangular cross-sections 120 of smoothly varying size, with smoothly varying twist 130 and at least one fillet 140. In FIG. 49, the passages 100 in exemplary cell 200 have square cross-sections 120 of smoothly varying size, with smoothly varying twist 130 and at least one fillet 140. In FIG. 50, the passages 100 in exemplary cell 200 have elliptical (ellipsoidal) cross-sections 120 of smoothly varying size, with smoothly varying twist 130. These pitches are exemplary only, however, as other cellular pitches can be used without departing from the scope of the present subject matter, as can the number of passages 100 in a cell 200 and the shape of each passage cross-section 120.

Figure 51:
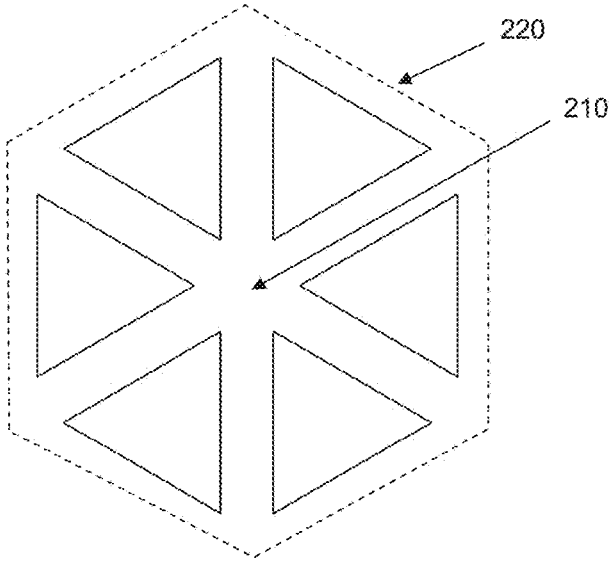
FIG. 51 illustrates an exemplary cell in a hexagonal cellular pitch with passages having triangular cross-sections.
Figure 52:
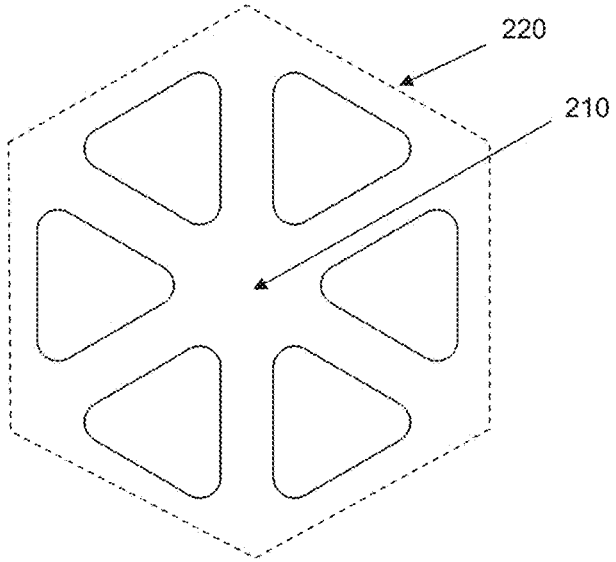
FIG. 52 illustrates an exemplary cell in a hexagonal cellular pitch with passages having filleted triangular cross-sections.
Figure 53:
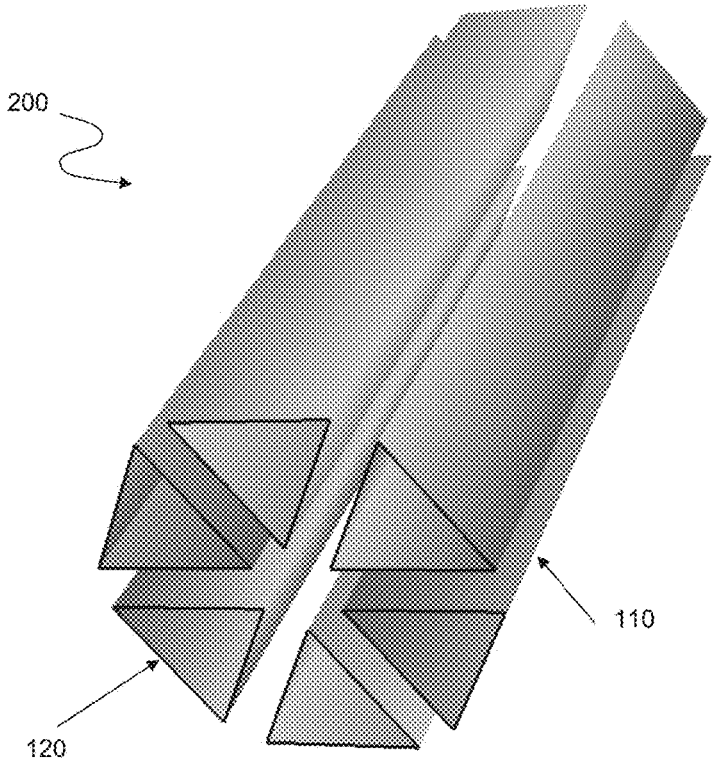
FIG. 53 illustrates a 3D view of an exemplary cell in a hexagonal cellular pitch with passages having triangular cross-sections.
Figure 54:
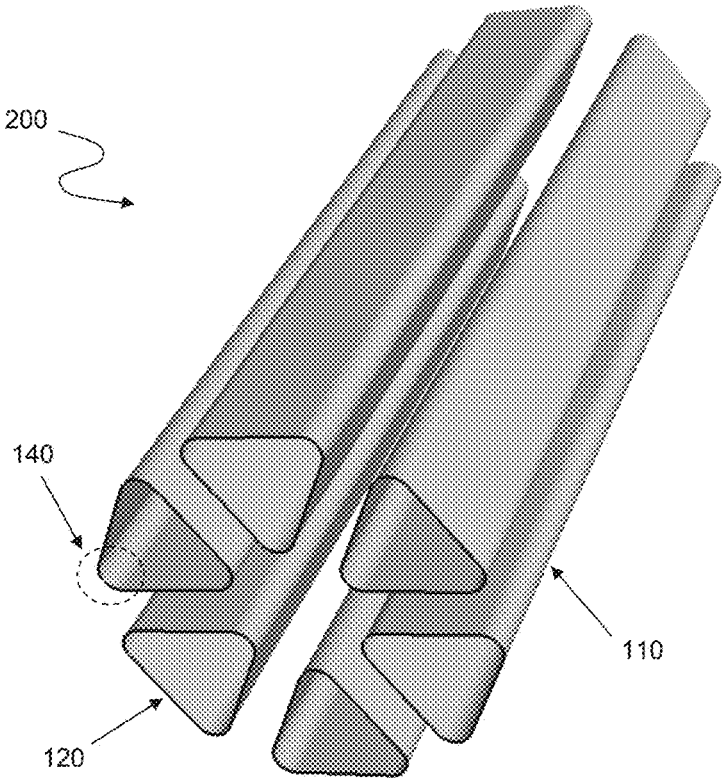
FIG. 54 illustrates a 3-D view of an exemplary cell in a hexagonal cellular pitch with passages having filleted triangular cross-sections.

FIGS. 51 and 52 illustrate exemplary cells 200 in a hexagonal cellular pitch 220. FIG. 53 illustrates a 3D view of the exemplary cell of FIG. 51, and FIG. 54 illustrates a 3D view of the exemplary cell of FIG. 52. In FIG. 51, the passages 100 in exemplary cell 200 have triangular cross-sections 120 with no twist 130 or fillet 140. In FIG. 52, the passages 100 in exemplary cell 200 have triangular cross-sections 120 and at least one fillet 140. Although not shown in the exemplary embodiments of FIGS. 51 and 52, cross-sections 120 of varying size can also be used. These embodiments are exemplary only, as other cell shapes can be used without departing from the scope of the present subject matter, as can the number of passages 100 in a cell 200 and the shape of each passage cross-section 120.

Heat transfer effectiveness of a cell 200 can be influenced by many factors. Conductive heat transfer, for example, is influenced at least in part by a temperature difference across one or more materials of the cell 200. In certain embodiments, temperature distributions vary with the amount of solid in the cell 200 through which heat is transferred. For certain embodiments, heat transfer is influenced by the physical arrangement of one or more coolant passages 100 and the geometric details of particular coolant passages 100. Non-limiting examples include cross-sectional geometry and/or twist.

Another factor influencing heat transfer in certain exemplary embodiments is angular orientation of passages 100 within a cell 200. Varying relative angular orientation of a passage 100 with respect to another passage 100 in a cell 200 is referred to as clocking. In certain exemplary embodiments, clocking is determined by the angular offset increment ($A_{OI}$) between passages 100 within a cell 200. The angular offset increment ($A_{OI}$), in degrees, is defined by the equation $$A_{OI}=360°\times(1-1/N_C)/N.$$

$N_C$ is the symmetry number of a cross-section 120, defined as the number of distinct lines subdividing a cross-sectional shape into equivalent images when the images are reflected about the subdividing lines. For example, $N_C=2$ for an ellipsoidal or rectangular cross-section, $N_C=3$ for a triangular cross-section, and $N_C=4$ for a square cross-section. Np is the number of passages in a cell 200. For example, $N_P=3$ for a cell with three passages (e.g., a triangular cellular pitch 220), and $N_P=4$ for a cell with four passages (e.g. a square or rectangular cellular pitch 220).

In a cell 200 having at least one passage 100 with twist 130, distance between passages 100 in a cell 200 and centroid 210 (defined as a ligament 230) can vary axially, as a passage wall 110 rotates toward or way from a centroid 210. Distance between a passage 100 and a cell centroid 210 can also vary with angular orientation as a passage wall 110 rotates toward or away from a centroid 210.

In certain exemplary embodiments, the relative angular offset distribution pattern in a cell 200 is set such that each passage 100 has an angular offset ($A_O$) that is a different increment of the angular offset increment ($A_{OI}$). Multiple cells 200 may use the same group of angular offset increments. The $N_P$ different values of the angular offset are defined by the equation $$A_O(i)=A_{OI}\times(i-1);\ \text{for } i=1 \text{ to } N_P.$$

Figure 74:
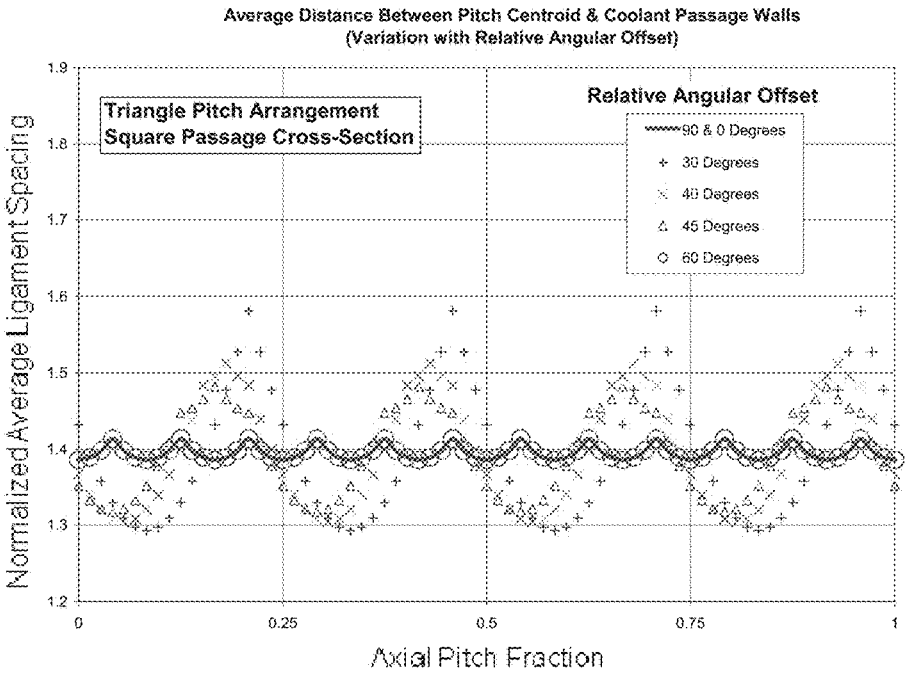
FIG. 74 illustrates normalized average ligament sizes in exemplary cells in a triangular cellular pitch with passages having square cross-sections.

Geometrically equivalent permutations are possible by adding increments of $360°/N_C$ to these values, or by using the reverse angle (negative of shown values), and removing increments of $360°/N_C$ from it (see FIG. 74, for example: 90° and 90°−(360°/4)=0° are equivalent).

Size of a ligament 230 is another exemplary factor influencing heat transfer in a cell 200. In certain exemplary embodiments, the larger the ligament 230 the higher the peak centerline temperature in the ligament 230. In certain exemplary embodiments, one way of reducing peak centerline temperature is to reduce the size of the ligament 230. One way of reducing the size of one or more ligaments 230 is to vary the shape of one or more passage cross-sections 120 ($N_C$) and/or the number of passages ($N_P$) making up a cell 200. In certain passage/cell combination, for example, the ligament 230 between an individual passage 100 and the cell centroid 210 is fixed, but the benefits of reduced ligament can still be achieved by altering the effective ligament size. This is done by evaluating the combined influence of the all of the individual ligaments in the cell—e.g. the axial distribution of the average ligament. Average ligament is defined as the distance between the cell centroid ($y_c$, $z_c$) and the coordinate of the mid-face nearest to the centroid for $i^{th}$ passage in the cell ($y_{mi}$, $z_{mi}$), with the distance summed over all passages in the cell and normalized by the number of passages in the cell. Angular offset distributed among passages in a cell 200, can also be used to control variations in average ligament size. Cells 200 can be configured such that passages 100 are in-phase (i.e., average ligament size variation is minimized), out of phase (average ligament size variation is maximized) or somewhere in between. The ($y_{mi}$, $z_{mi}$) coordinate set will vary in the axial direction (x) as the passage faces rotate toward or away from the centroid 210 over a full pitch length. This parameter is normalized to make the distribution independent of the absolute size of the cell pitch ($L_{ref}$): Normalized Average Ligament(x)=Summation over each $i^{th}$ passage in the cell $[((y_{mi}(x)-y_c)^2+(z_{mi}(x)-z_c)^2)^{1/2}]/Np/L_{ref}$; with x going from zero to the axial pitch length.

FIGS. 55-62 illustrate various cells 200 having square cellular pitch 220, with various examples of passage twist 130, which can be measured using axial pitch. As previously discussed, axial pitch is twist 130, with twist defined as the reciprocal of the axial distance in which a passage cross-section 120 undergoes a 360 degree rotation (example: twist of one rotation in four inches=twist of 0.25 rotations/inch). For example, a 1/12 pitch is the axial span over which a passage 100 has undergone a rotation of 1/12 of 360 degrees (i.e., 30 degrees). An axial pitch fraction of 1/24 means that there is an axial rotation of 1/24 of 360 degrees (i.e. 15 degrees). By a repeating pitch, it is meant that the relative offset among the passages 100 at which the relative angular offset between passages 100 in a cell 200 repeats. As an example, a repeating pitch of 1/12 means that a relative angular offset pattern repeats axially with every 30 degrees of rotation.

FIGS. 55-57 illustrate exemplary cells 200 having square cellular pitch 220 with passages 100 having triangular, square, and elliptical passage cross-sections 120 respectively, where the passages 100 have a 0 degree relative angular offset. FIGS. 58-60 illustrate exemplary cells 200 having square cellular pitch 220 and triangular, square and elliptical passage cross-sections 120 respectively, with variations in relative angular offset between passages 100. In FIG. 58, the relative angular offset between passages 100 in the cell 200 is 60 degrees. In FIG. 59 the relative angular offset between passages 100 in the cell 200 is 67.5 degrees, and in FIG. 60 the relative angular offset between passages 100 in the cell 200 is 45 degrees. FIGS. 61 and 62 illustrate exemplary cells 200 having square cellular pitch 220 with elliptical and triangular passage cross-sections 120 respectively. The relative angular offset between passages 100 in these exemplary cells 200 is 90 degrees.

In certain exemplary embodiments, varying the relative angular offset of passages 100 in a cell 200 varies the size of the individual ligaments 230 in a cell 200 and changes the cell's axial distribution of the average ligament size. Large variations in average ligament size result in large variations in peak centerline temperatures in a cell 200, which is undesirable.

Average ligament size variations can be controlled by varying the relative angular offset of passages 100 in a cell 200. This variation can be used to control size of ligaments 230 in a cell 200, so that large variations in the average ligament are avoided.

Figure 63:
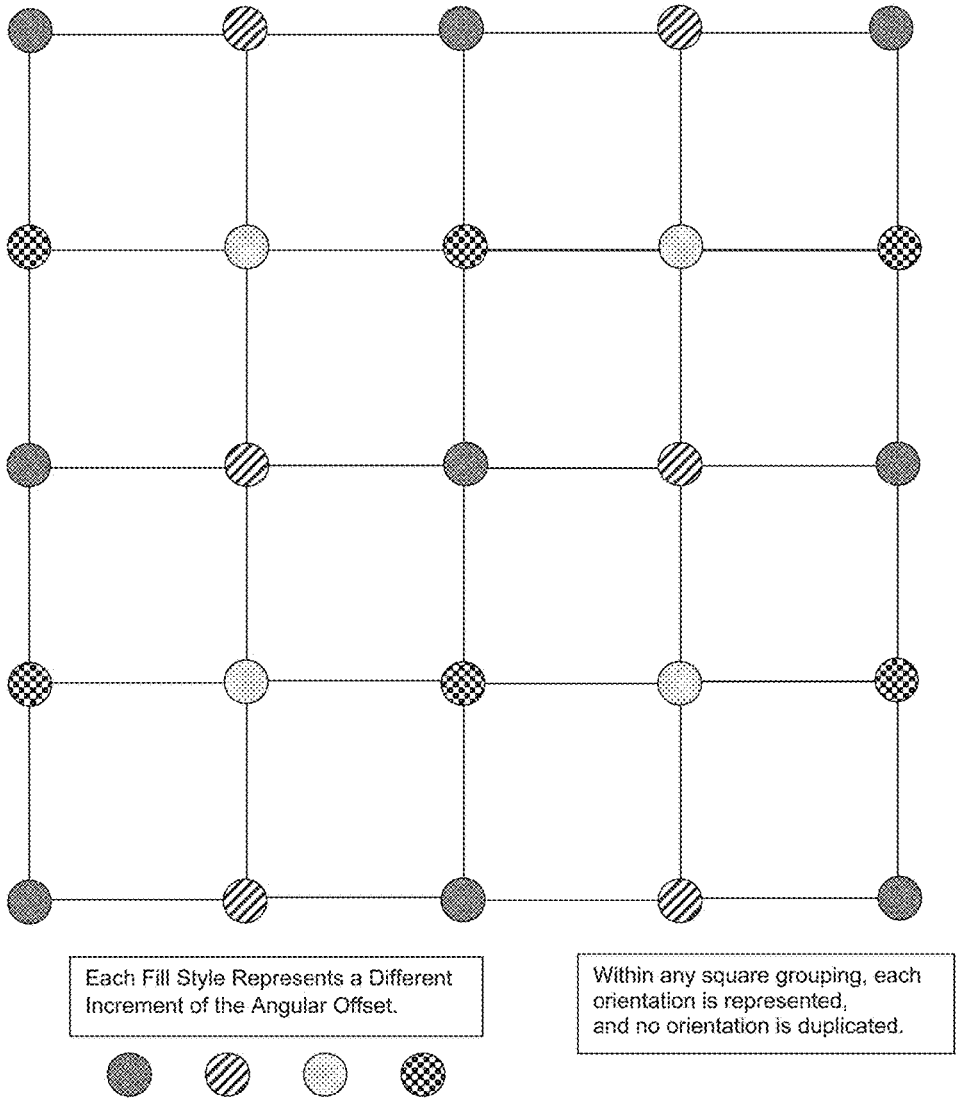
FIG. 63 illustrates a relative angular offset distribution pattern for an exemplary square radial pitch arrangement.
Figure 64:
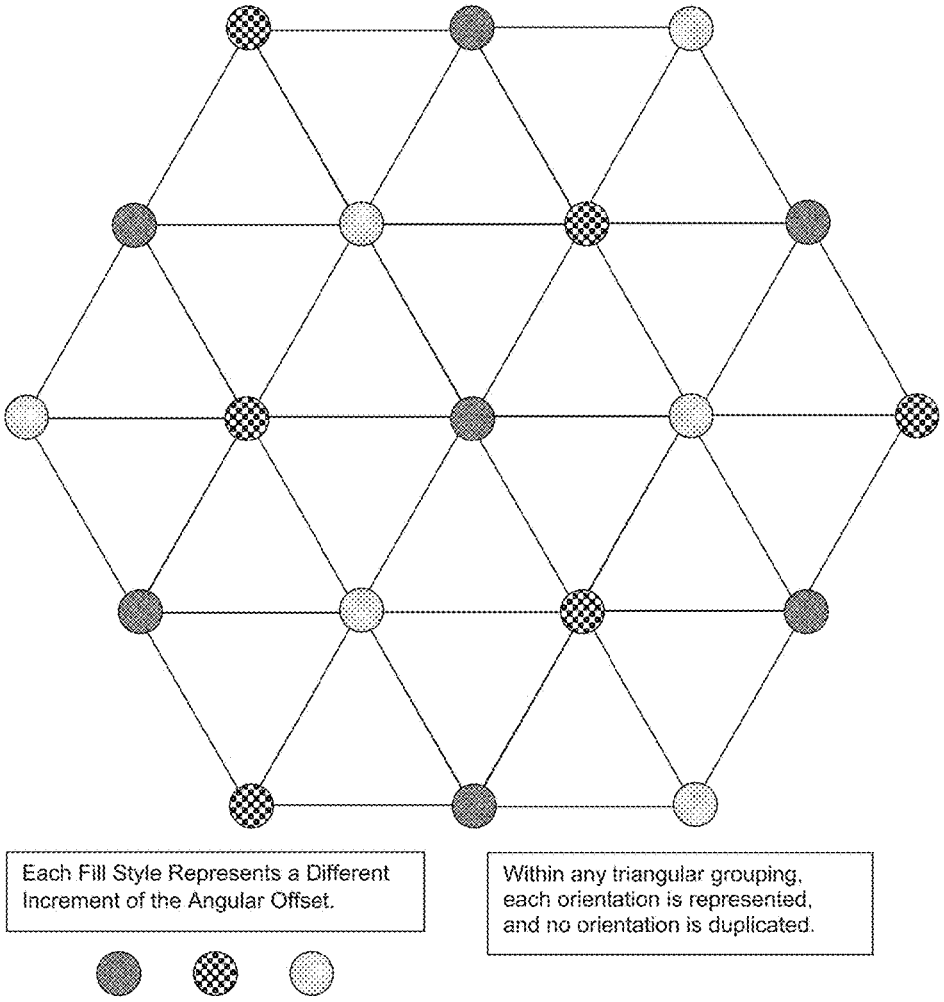
FIG. 64 illustrates a relative angular offset distribution pattern for an exemplary triangular radial pitch arrangement.

FIGS. 63 and 64 illustrate exemplary cellular pitch 220 arrangements. The relative angular offset of the passages 100 is illustrated by the multiple fill styles shown in these two figures, wherein each fill style represents a different increment of the angular offset. In the exemplary arrangement of FIG. 63, within any square grouping multiple orientations are represented, with no orientation duplicated. In the exemplary arrangement of FIG. 64, multiple triangular grouping orientations are represented, with no orientation duplicated. Although not shown in these exemplary embodiments, fill styles and/or orientations can be repeated without departing from the scope of the present subject matter.

For certain exemplary embodiments, the size of the relative angular offset increment is shown in Table 1 for selected cellular pitch and cross-sectional geometry combinations.

TABLE 1

Relative Angular Offset Increment Values for Radial Pitch and Cross-section Geometry Combinations

| Passage Angular Offset Increments (in degrees) | | Cross-sectional Geometry | | | |
|---|---|---|---|---|---|
| | | Ellipse | Rectangle | Triangle | Square |
| Cellular Pitch | Square | 45° | 45° | 60° | 67.5° |
| | Triangle | 60° | 60° | 80° | 90° |

Figure 65:
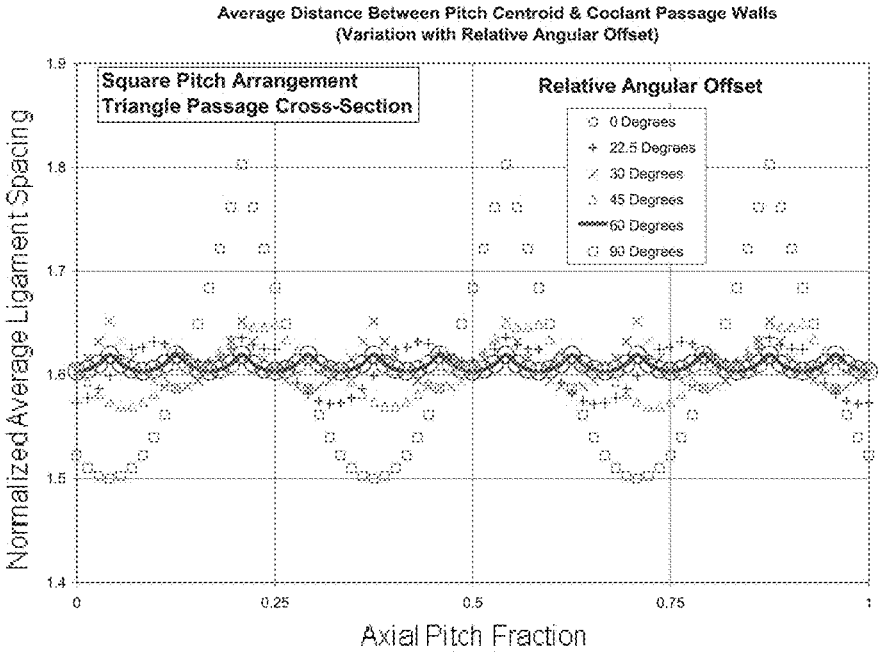
FIG. 65 illustrates normalized average ligament sizes in exemplary cells in a square cellular pitch with passages having triangular cross-sections.
Figure 66:
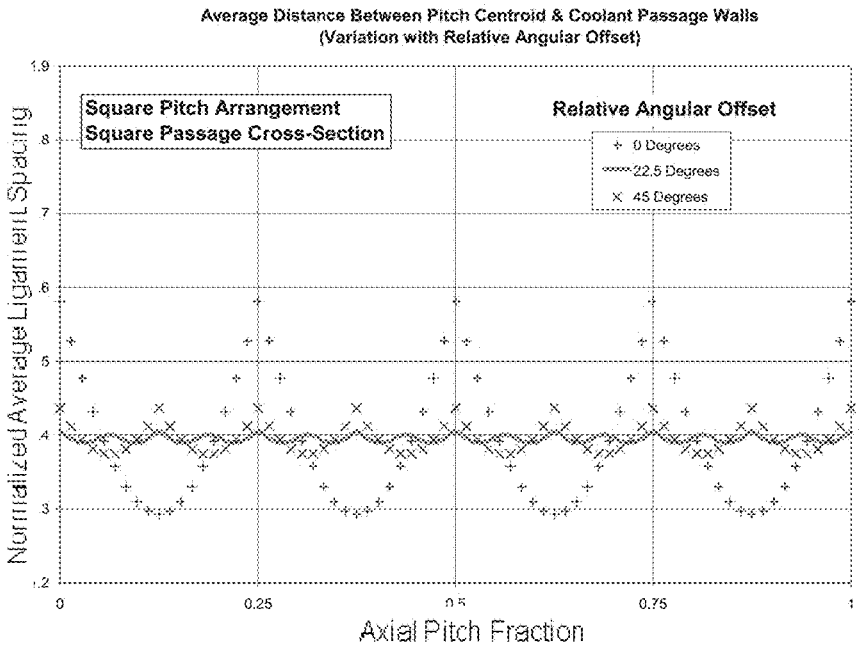
FIG. 66 illustrates normalized average ligament sizes in exemplary cells in a square cellular pitch with passages having square cross-sections.
Figure 67:
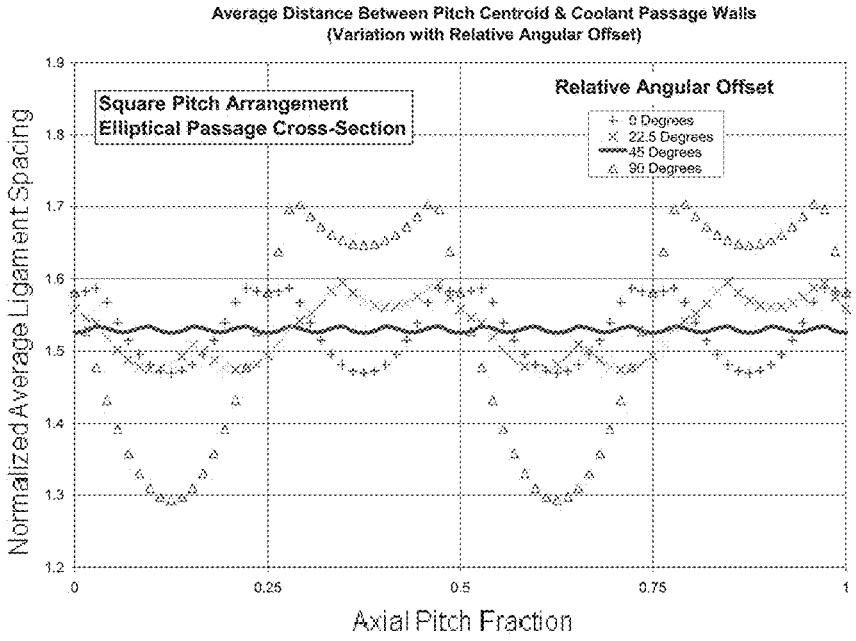
FIG. 67 illustrates normalized average ligament sizes in exemplary cells in a square cellular pitch with passages having elliptical/rectangular cross-sections.

The angular offset increments from the equation $A_{OI}=360°\times(1-1/N_C)/N_P$ as shown in Table 1 produce cross-sectional orientations that minimize variation in the size of a ligament 230, as illustrated in the exemplary cells 200 shown in FIGS. 58-60 and 69, 73, and 76 (discussed below). This improves thermal performance by helping minimize average ligament variations. FIGS. 65-67, for example, illustrate normalized graphs showing average ligament size as a function of relative angular offset increments between passages 100 in a cell 200. FIG. 65 illustrates average ligament sizes in a cell 200 having a square cellular pitch 220 and passages with triangular cross-sections 120 (as shown, for example, in FIGS. 55 and 61). As shown in FIG. 65, cells 200 having passages 100 with relative angular offset increments of 0 and 60 degrees had the lowest variation in average ligament size, while cells 200 having passages with a 90 degree angular offset increment had the largest variation.

The relative angular offset identified in Table 1 and the $A_{OI}$ equation match the offsets that yield the lowest variation in average ligament size. In two examples (0 degrees on square cellular pitch/triangular cross-section and 90 degrees on triangular cellular pitch/square cross-section), there was another angle, not in Table 1, that also matched the lowest variation. However, these particular angles are not advantageous to effective heat transfer. They are not advantageous to effective heat transfer because even though they may have low centroid-to-passage ligament variations, they have large midface-to-passage ligament variations as measured along the lines segments forming the cellular pitch pattern. This large variation is undesirable as it would also cause large temperature variations.

FIG. 66 illustrates average ligament sizes in a cell 200 with square cellular pitch 220 and passages 100 with square cross-sections 120. As shown in FIG. 66, a relative angular offset of 67.5 degrees results in the lowest variation in average ligament size (22.5°−90°=−67.5°, and −67.5° being equivalent to +67.5°), while a 0 degree angular offset (as shown in FIG. 56 for example) resulted in the largest variation. FIG. 67 illustrates average ligament size in a cell 200 with square cellular pitch 220 and passages 100 with elliptical cross-sections 120. As shown in FIG. 67, passages 100 with a 45 degree angular offset (as shown in FIG. 60 for example) resulted in the lowest variation in average ligament size, while passages 100 with a 90 degree angular offset (as shown in FIG. 62 for example) resulted in the largest variation.

Figure 70:
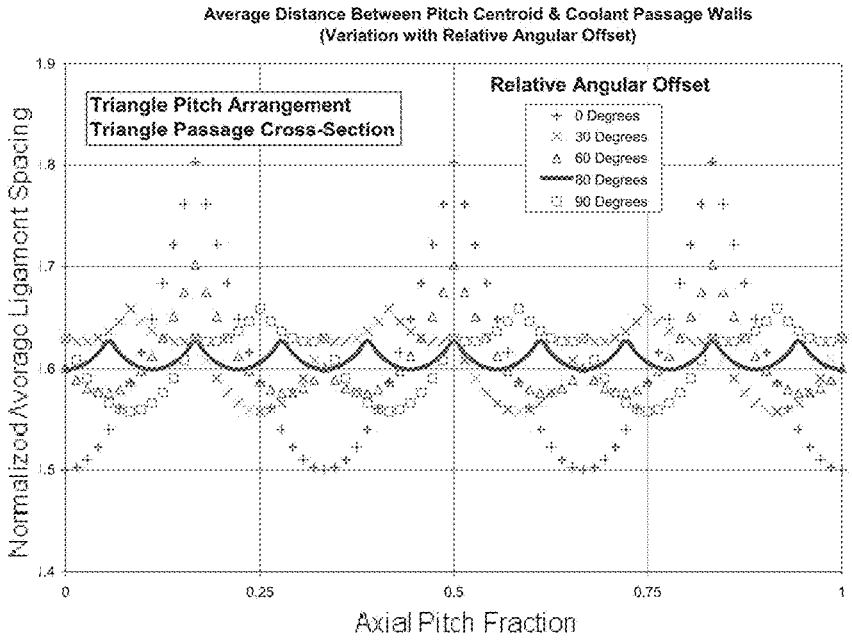
FIG. 70 illustrates normalized average ligament sizes in exemplary cells in a triangular cellular pitch with passages having triangular cross-sections.

FIGS. 68 and 69 illustrate exemplary cells 200 having triangular cellular pitch 220 and passages 100 with triangular cross-sections 120. In FIG. 68 the passages 100 have a 0 degree relative angular offset, while in FIG. 69 the passages 100 have an 80 degree relative angular offset. FIG. 70 illustrates normalized graphs showing average ligament sizes as a function of relative angular offset between passages 100 in a cell 200 in the exemplary cells 20 of FIGS.

68 and 69. As shown in FIG. 70, cells 200 having passages 100 with a relative angular offset of 80 degrees (as shown in FIG. 69 for example) had the lowest variation in average ligament size, while cells 200 having passages 100 with a 90 degree angular offset had the largest variations in average ligament size.

FIGS. 71-73 illustrate exemplary cells 200 having triangular cellular pitch 220 and passages 100 with square cross-sections 120. In FIG. 71 the passages 100 have a 30 degree relative angular offset, in FIG. 72 the passage have a 60 degree relative angular offset, and in FIG. 69 the passages 100 have a 90 degree relative angular offset. FIG. 74 illustrates normalized graphs showing average ligament sizes as a function of relative angular offset between passages 100 in a cell 200 in the exemplary embodiments of FIGS. 71-73. As shown in FIG. 74, cells 200 having passages 100 with a relative angular offset of 60 degrees (as shown in FIG. 71 for example) and cells having passages 100 with a relative angular offset of 90 degrees (as shown in FIG. 73 for example) had the lowest variation in average ligament size, while cells 200 having passages 100 with a 30 degree angular offset had the largest variation.

Figure 78:
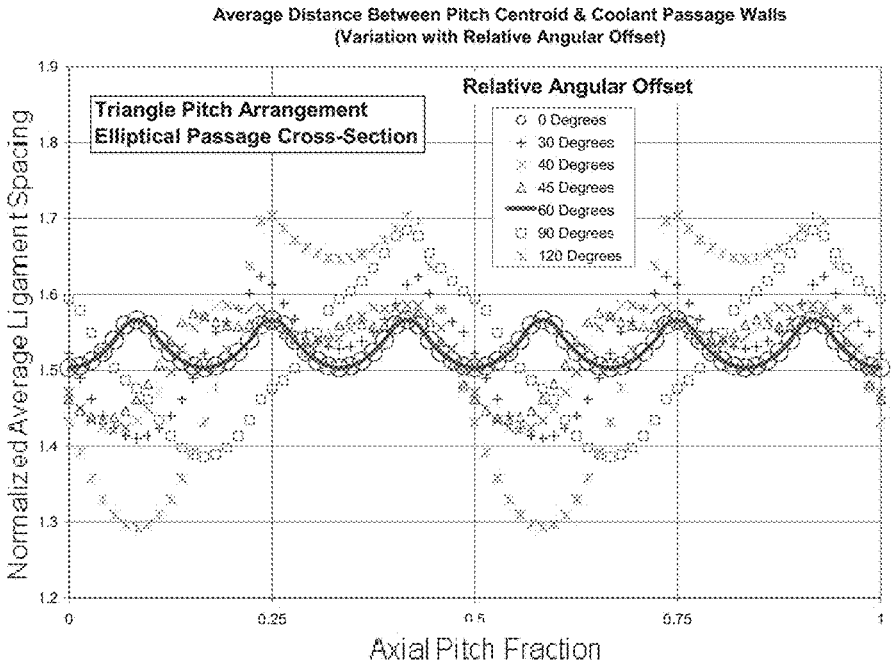
FIG. 78 illustrates normalized average ligament sizes in exemplary cells in a triangular cellular pitch with passages having elliptical/rectangular cross-sections.

FIGS. 75-77 illustrate exemplary cells 200 having triangular cellular pitch 220 and passages 100 with elliptical cross-sections 120. In FIG. 75 the passages 100 have a 0 degree relative angular offset, in FIG. 76 the passage have a 60 degree relative angular offset, and in FIG. 69 the passages 100 have a 120 degree relative angular offset. FIG. 78 illustrates normalized graphs showing average ligament sizes as a function of relative angular offset between passages 100 in a cell 200 in the exemplary cells 20 of FIGS. 75-77. As shown in FIG. 78, cells 200 having passages 100 with a relative angular offset of 0 degrees or 60 degrees (as shown in FIGS. 75 and 76, for example) had the lowest variation in average ligament size, while cells 200 having passages 100 with a 120 degree angular offset (as shown in FIG. 77 for example) had the largest variation in average ligament size.

CONCLUSION

The embodiments discussed here are exemplary only. Many additional changes in the details, materials, steps and arrangement of parts, which have been herein described and illustrated to explain the nature of the subject matter, may be made by those skilled in the art within the principle and scope of the specification and of the appended claims without departing from the scope of the present subject matter.

What is claimed is:

1. A coolant system configured to convey flowing coolant wherein the flowing coolant has a coolant pressure, the coolant system comprising:
- an inlet plenum
- an outlet plenum; and
- a plurality of coolant passages, wherein
- each coolant passage in the plurality of coolant passages is non-vaned and non-circular,
- each coolant passage has a cross-sectional shape configured to introduce to the flowing coolant a swirl with a pressure gradient towards a center of rotation of the swirl and the cross-sectional shape is defined by a perimeter of the coolant passage,
- each coolant passage has an uninterrupted flow area that extends from a first perimeter wall to an opposite perimeter wall,
- the plurality of coolant passages are connected in parallel between the inlet plenum and the outlet plenum,
- each coolant passage of the plurality of coolant passages is positioned to form a ligament with a neighboring coolant passage,
- the plurality of coolant passages are twisted to have a polygonal repeating cellular pitch so that the ligament of any pair of coolant passages varies with respect to a centroid of another pair of coolant passages so that the cellular pitch has an average ligament variation,
- each coolant passage of the plurality of non-circular coolant passages has a cross-sectional size variation in an axial flow direction,
- the cross-sectional size variation is configured to control the coolant pressure in the axial flow direction, and
- the plurality of coolant passages are clocked so that a first angular orientation of a first passage in the cellular pitch is offset from a second angular orientation of a second passage in the cellular pitch, wherein the angular offset minimizes an average ligament variation.

2. The coolant system of claim 1, wherein an angular orientation of a cross-section of at least one coolant passage varies in the axial flow direction so that the coolant pressure varies in the axial flow direction.

3. The coolant system of claim 1, wherein the plurality of passages forms a cell having a square cellular pitch.

4. The coolant system of claim 1, wherein the plurality of passages forms a cell having a triangular cellular pitch.

5. The coolant system of claim 1, wherein the plurality of passages forms a cell having a hexagonal cellular pitch.

6. The coolant system of claim 1, wherein a wall of at least one of the plurality of coolant passages is opposite another wall of another of the plurality of coolant passages.

7. The coolant system of claim 1, wherein at least two of the plurality of coolant passages have a same angular variation.

8. A coolant system, comprising:
- an inlet plenum
- an outlet plenum; and
- a plurality of coolant passages connected in parallel between the inlet plenum and the outlet plenum, wherein
- each of the plurality of coolant passages are non-vaned and have a non-circular cross-sectional shape and the non-circular cross-sectional shape is defined by a perimeter of the coolant passage,
- each coolant passage has an uninterrupted flow area that extends from a first perimeter wall to an opposite perimeter wall,
- in at least one of the plurality of coolant passages a size of at least one passage cross-section varies in an axial flow direction, and
- the plurality of coolant passages are twisted and have a repeating cellular pitch, so that an angular offset of each of the plurality of coolant passages with respect to each other is defined by the equation $$A_{OI}=360°\times(1-1/N_C)/N_P$$

Np=3, $A_{OI}$ is selected from the group consisting of 60, 80, and 90, and

Nc is selected from the group consisting of 2, 3, and 4.

9. A coolant system configured to convey flowing coolant wherein the flowing coolant has a coolant pressure, the coolant system comprising:
- an inlet plenum
- an outlet plenum; and a plurality of coolant passages, wherein each coolant passage of the plurality of coolant passages is non-vaned and has a non-circular cross-sectional shape configured to introduce a swirl to the flowing coolant and the non-circular cross-sectional shape is defined by a perimeter of the coolant passage, the plurality of coolant passages are connected in parallel between the inlet plenum and the outlet plenum, each coolant passage of the plurality coolant passages is positioned to form a ligament with a neighboring coolant passage, the plurality of coolant passages are clocked so that an angular orientation of any coolant passage of the plurality of coolant passages is offset from a neighboring angular orientation of at least one neighboring coolant passage by an angular offset increment in a cellular pitch and the angular offset minimizes an average ligament variation, the plurality of coolant passages are twisted to have a polygonal repeating cellular pitch so that the ligament of any pair of coolant passages varies with respect to a centroid of another pair of coolant passages so that the cellular pitch has an average ligament variation, each coolant passage of the plurality of coolant passages has a cross-sectional size variation in an axial flow direction and a cross-sectional area that defines a flow area for the flowing coolant, and the cross-sectional size variation is configured to control the coolant pressure in the axial flow direction.

10. The coolant passage of claim 9, wherein the passage cross-section size varies uniformly.

11. The coolant passage of claim 9, wherein the passage cross-section size varies incrementally.

12. The coolant passage of claim 9, wherein an angular orientation of the passage cross-section varies in the axial direction.

13. The coolant passage of claim 12, wherein the passage cross-section angular orientation varies uniformly.

14. The coolant passage of claim 12, wherein the passage cross-section angular orientation varies incrementally.

15. The coolant passage of claim 9, further comprising at least one fillet defining at least one smooth finite radius of curvature between at least two adjoining passage walls.

* * * * *